US011788759B2

(12) United States Patent
Takegami et al.

(10) Patent No.: US 11,788,759 B2
(45) Date of Patent: Oct. 17, 2023

(54) REFRIGERATION SYSTEM AND HEAT SOURCE UNIT

(71) Applicant: DAIKIN INDUSTRIES, LTD., Osaka (JP)

(72) Inventors: Masaaki Takegami, Osaka (JP); Shuichi Taguchi, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 18/090,836

(22) Filed: Dec. 29, 2022

(65) Prior Publication Data

US 2023/0140815 A1 May 4, 2023

Related U.S. Application Data

(63) Continuation of application No. PCT/JP2021/021014, filed on Jun. 2, 2021.

(30) Foreign Application Priority Data

Jun. 30, 2020 (JP) ..... 2020-112591

(51) Int. Cl.
*F24F 11/84* (2018.01)
*F25B 41/20* (2021.01)
*F25B 13/00* (2006.01)

(52) U.S. Cl.
CPC ..... *F24F 11/84* (2018.01); *F25B 13/00* (2013.01); *F25B 41/20* (2021.01)

(58) Field of Classification Search
CPC .... F24F 11/84; F24F 2140/10; F24F 2140/12; F25B 41/20; F25B 41/33; F25B 2500/07; F25B 13/00; F25B 2309/06; F25B 9/008
See application file for complete search history.

(56) References Cited

U.S. PATENT DOCUMENTS

2008/0209926 A1 9/2008 Matsuoka et al.
2021/0180802 A1 6/2021 Ukibune et al.
2022/0113064 A1* 4/2022 Takegami ..... F25B 49/02

FOREIGN PATENT DOCUMENTS

EP 3064847 A1 9/2016
FR 2 775 339 A1 8/1999
(Continued)

OTHER PUBLICATIONS

English Translation of Ukibune et al. (JP 2020051727 A). (Year: 2020).*
(Continued)

*Primary Examiner* — Miguel A Diaz
(74) *Attorney, Agent, or Firm* — Birch, Stewart, Kolasch & Birch, LLP

(57) ABSTRACT

A refrigerant circuit (11), in which carbon dioxide circulates as a refrigerant, includes a plurality of heat exchangers (12), a receiver (60), a degassing passage (61), and a degassing valve (62). The refrigeration system implements a first operation during which one of the plurality of heat exchangers (12) functions as a radiator while two of the plurality of heat exchangers (12) function as evaporators, and the refrigerant flows from the heat exchanger (12) functioning as a radiator into the receiver (60) and then flows from the receiver (60) into each of the two heat exchangers (12) functioning as evaporators. The control unit (15) changes the degassing valve (62) from a closed state to an open state when a pressure (RP) in the receiver (60) exceeds a first pressure (Pth1) set in advance, in the first operation.

18 Claims, 9 Drawing Sheets

(56) References Cited

FOREIGN PATENT DOCUMENTS

| | | | | |
|---|---|---|---|---|
| JP | 2008-23072 | A | | 1/2006 |
| JP | 2009-243829 | A | | 10/2009 |
| JP | 2013-36650 | A | | 2/2013 |
| JP | 2014-152937 | A | | 8/2014 |
| JP | 2015-87042 | A | | 5/2015 |
| JP | 2018/87675 | A | | 6/2018 |
| JP | 2020051727 | A | * | 4/2020 |
| WO | WO 2020/067189 | A1 | | 4/2020 |

OTHER PUBLICATIONS

English translation of the International Preliminary Report on Patentability and Written Opinion of the International Searching Authority for International Application No. PCT/JP2021/021014, dated Jan. 12, 2023.
International Search Report, issued in PCT/JP2021/021014, PCT/ISA/210, dated Jul. 6, 2021.
Written Opinion of the International Searching Authority, issued in PCT/JP2021/021014, PCT/ISA/237, dated Jul. 6, 2021.

* cited by examiner

REFRIGERATION SYSTEM AND HEAT SOURCE UNIT

CROSS REFERENCE TO RELATED APPLICATIONS

This application is a Continuation of PCT International Application No. PCT/JP2021/021014 filed on Jun. 2, 2021, which claims priority under 35 U.S.C. § 119(a) to Patent Application No. 2020-112591 filed in Japan on Jun. 30, 2020, all of which are hereby expressly incorporated by reference into the present application.

TECHNICAL FIELD

The present disclosure relates to a refrigeration system and a heat source unit.

BACKGROUND ART

Patent Literature 1 discloses an air conditioning apparatus including a refrigerant circuit filled with carbon dioxide as a refrigerant. This air conditioning apparatus carries out a cooling operation during which an outdoor heat exchanger functions as a radiator while two indoor heat exchangers each function as an evaporator.

In this cooling operation, the refrigerant is compressed to a supercritical region by a compressor and is discharged from the compressor. The refrigerant then flows into an outdoor expansion valve via a four-way switching valve and the outdoor heat exchanger. The refrigerant, when flowing into the outdoor expansion valve, is decompressed from the supercritical region to a two-phase region. The refrigerant in the two-phase state flows out of the outdoor expansion valve and then flows into a receiver via a check valve bridge circuit. The receiver is a container for temporarily storing the refrigerant in the two-phase state. The liquid refrigerant then flows out of the receiver, and passes through the check valve bridge circuit. The liquid refrigerant is then diverted at two indoor expansion valves. The liquid refrigerants thus diverted then flow into the two indoor heat exchangers, respectively.

CITATION LIST

Patent Literature

Patent Literature 1: JP 2009-243829 A

SUMMARY

An aspect of the present disclosure is directed to a refrigeration system. The refrigeration system includes: a refrigerant circuit (11) in which carbon dioxide circulates as a refrigerant; and a control unit (15). The refrigerant circuit (11) includes: a plurality of heat exchangers (12); a receiver (60); a degassing passage (61) through which the refrigerant in a gas state is discharged from the receiver (60); and a degassing valve (62) disposed on the degassing passage (61). The refrigeration system implements a first operation during which one of the plurality of heat exchangers (12) functions as a radiator while two of the plurality of heat exchangers (12) function as evaporators, and the refrigerant flows from the heat exchanger (12) functioning as a radiator into the receiver (60) and then flows from the receiver (60) into each of the two heat exchangers (12) functioning as evaporators. The control unit (15) changes the degassing valve (62) from a closed state to an open state on condition that a pressure (RP) in the receiver (60) exceeds a first pressure (Pth1) set in advance, in the first operation.

DESCRIPTION OF EMBODIMENTS

Embodiments will be described in detail below with reference to the drawings. In the respective drawings, identical or corresponding portions are denoted with identical reference signs; therefore, the description thereof will not be given repeatedly.

First Embodiment

Figure 1:
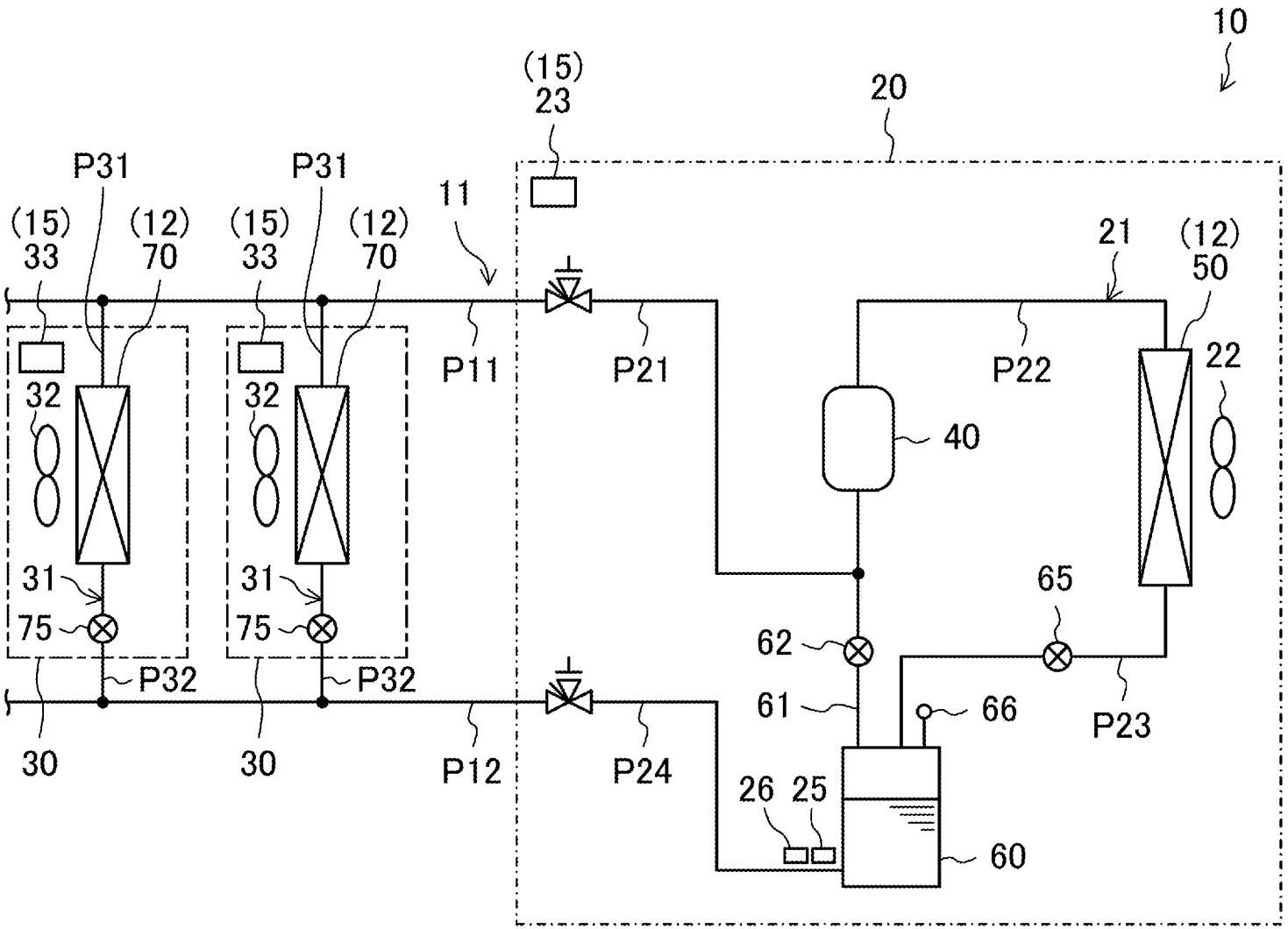
FIG. 1 is a diagram of a piping system as an exemplary configuration of a refrigeration system according to a first embodiment.

FIG. 1 illustrates an exemplary configuration of a refrigeration system (10) according to a first embodiment. The refrigeration system (10) includes a heat source unit (20) and a plurality of utilization units (30). In this example, the refrigeration system (10) includes two utilization units (30). The refrigeration system (10) is configured to cool air in a room. The heat source unit (20) is installed outside the room. The utilization units (30) are installed in the room.

The heat source unit (20) includes a heat source circuit (21), a heat source fan (22), and a heat source control unit (23). Each of the utilization units (30) includes a utilization circuit (31), a utilization fan (32), and a utilization control unit (33). The heat source circuit (21) of the heat source unit (20) and the utilization circuits (31) of the utilization units (30) are connected with a gas connection passage (P11) and a liquid connection passage (P12). In this example, the utilization circuits (31) of the utilization units (30) are connected in parallel with the heat source circuit (21) of the heat source unit (20). Specifically, the heat source circuit (21) has a gas end connected to the gas connection passage (P11) and a liquid end connected to the liquid connection passage (P12). Each utilization circuit (31) has a gas end connected to the gas connection passage (P11) and a liquid end connected to the liquid connection passage (P12).

The heat source circuit (21) of the heat source unit (20) and the utilization circuits (31) of the utilization units (30) are connected as described above to constitute a refrigerant circuit (11). The refrigerant circuit (11) is filled with carbon dioxide as a refrigerant. A refrigeration cycle is achieved in such a manner that the refrigerant circulates through the refrigerant circuit (11). During this refrigeration cycle, a high pressure at the refrigerant circuit (11) is equal to or higher than a critical pressure of the refrigerant.

[Heat Source Circuit]

The heat source circuit (21) includes a compression element (40), a heat source heat exchanger (50), a receiver (60), a degassing passage (61), a degassing valve (62), a heat source expansion valve (65), and a pressure release valve (66). The heat source circuit (21) also includes first to fourth heat source passages (P21 to P24). The first to fourth heat source passages (P21 to P24) each include, for example, a refrigerant pipe.

<Compression Element>

The compression element (40) is configured to suck in, compress, and discharge the refrigerant. Specifically, the compression element (40) compresses the refrigerant such that the pressure of the refrigerant becomes equal to or higher than the critical pressure of the refrigerant.

In this example, the compression element (40) includes one compressor. The compression element (40) has an inlet corresponding to a suction port of the compressor, and an outlet corresponding to a discharge port of the compressor. For example, the compressor of the compression element (40) is a rotary compressor including an electric motor and a compression mechanism configured to rotate when being driven by the electric motor. The compressor of the compression element (40) is also a variable capacity compressor of which the number of rotations (the operating frequency) is adjustable.

The first heat source passage (P21) connects a first end of the gas connection passage (P11) and the suction port of the compressor corresponding to the inlet of the compression element (40).

<Heat Source Fan>

The heat source fan (22) is disposed near the heat source heat exchanger (50) and is configured to provide heat source air to the heat source heat exchanger (50). In this example, the heat source air is outdoor air.

<Heat Source Heat Exchanger>

The heat source heat exchanger (50) is configured to cause the refrigerant flowing through the heat source heat exchanger (50) to exchange heat with the heat source air provided to the heat source heat exchanger (50). The heat source heat exchanger (50) is, for example, a fin-and-tube heat exchanger.

The second heat source passage (P22) connects a gas end of the heat source heat exchanger (50) and the discharge port of the compressor corresponding to the outlet of the compression element (40).

<Receiver>

The receiver (60) is configured to store the refrigerant and to separate the stored refrigerant into the gas refrigerant and the liquid refrigerant. The receiver (60) is, for example, a cylindrical pressure container. The receiver (60) has an inlet, a liquid outlet, and a gas outlet. The receiver (60) has the liquid outlet on its lower side (specifically, a portion below a heightwise center of the receiver). The receiver (60) has the gas outlet on its upper side (specifically, a portion above the heightwise center of the receiver).

The third heat source passage (P23) connects the inlet of the receiver (60) and a liquid end of the heat source heat exchanger (50). The fourth heat source passage (P24) connects the liquid outlet of the receiver (60) and a first end of the liquid connection passage (P12).

<Degassing Passage>

The degassing passage (61) is a passage through which the refrigerant in the gas state is discharged from the receiver (60). The degassing passage (61) includes, for example, a refrigerant pipe. In this example, the degassing passage (61) has a first end connected to the gas outlet of the receiver (60) and a second end connected to a midway portion of the first heat source passage (P21) connected to the inlet of the compression element (40). The refrigerant in the gas state discharged from the receiver (60) through the degassing passage (61) is sucked into the compression element (40).

<Degassing Valve>

The degassing valve (62) is disposed on the degassing passage (61). When the degassing valve (62) is changed from a closed state to an open state, the refrigerant in the gas state is discharged from the receiver (60) through the degassing passage (61). When the degassing valve (62) is changed from the open state to the closed state, the refrigerant in the gas state is not discharged from the receiver (60) through the degassing passage (61). In this example, the degassing valve (62) has an adjustable opening degree. The degassing valve (62) is, for example, an electric valve.

<Heat Source Expansion Valve>

The heat source expansion valve (65) is disposed on the third heat source passage (P23). The heat source expansion valve (65) has an adjustable opening degree. The heat source expansion valve (65) is, for example, an electric valve.

<Pressure Release Valve>

The pressure release valve (66) works when a pressure (RP) in the receiver (60) exceeds a working pressure set in advance. In this example, the pressure release valve (66) is disposed on the receiver (60). When the pressure release valve (66) works, the refrigerant in the receiver (60) is discharged from the receiver (60) via the pressure release valve (66). The working pressure is higher than the critical pressure (7.38 MPa) of the refrigerant. The working pressure is set at, for example, 8.4 MPa.

[Various Sensors in Heat Source Unit]

The heat source unit (20) includes various sensors (not illustrated) such as a pressure sensor and a temperature sensor. Examples of physical quantities to be detected by these various sensors may include, but not limited to, a pressure and a temperature of the high-pressure refrigerant in the refrigerant circuit (11), a pressure and a temperature of the low-pressure refrigerant in the refrigerant circuit (11), a pressure and a temperature of the intermediate-pressure refrigerant in the refrigerant circuit (11), a pressure and a temperature of the refrigerant in the heat source heat exchanger (50), and a temperature of air to be sucked into the heat source unit (20). The various sensors each transmit a detection signal indicating a detection result to the heat source control unit (23).

In this example, the various sensors of the heat source unit (20) include a receiver pressure sensor (25) and a receiver temperature sensor (26). The receiver pressure sensor (25) is configured to detect the pressure in the receiver (60) (specifically, the pressure of the refrigerant). The receiver temperature sensor (26) is configured to detect the temperature in the receiver (60) (specifically, the temperature of the refrigerant).

[Heat Source Control Unit]

Figure 2:
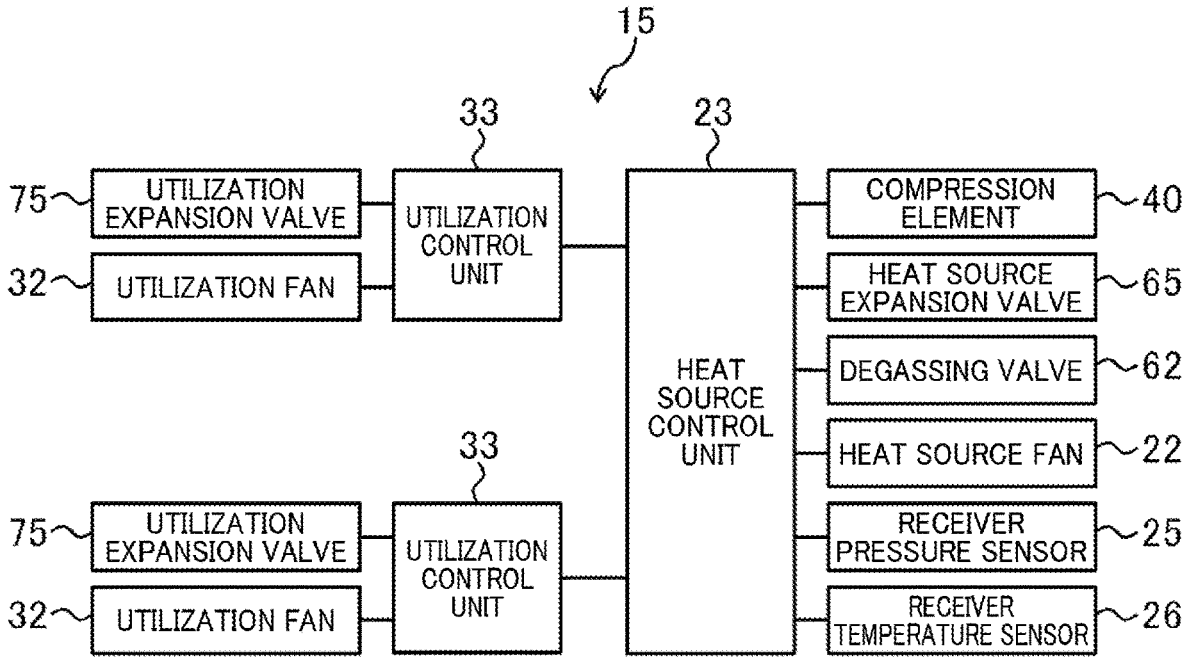
FIG. 2 is a block diagram of an exemplary configuration of a control unit according to the first embodiment.

The heat source control unit (23) is connected to the various sensors of the heat source unit (20) and the respective constituent elements of the heat source unit (20), through communication lines. As illustrated in FIG. 2, the heat source control unit (23) is connected to the compression element (40), the heat source expansion valve (65), the degassing valve (62), the heat source fan (22), the receiver pressure sensor (25), the receiver temperature sensor (26), and the like. The heat source control unit (23) receives an external signal transmitted outside the heat source unit (20). The heat source control unit (23) controls the respective constituent elements of the heat source unit (20), based on the detection signals from the various sensors of the heat source unit (20) and the external signal transmitted outside the heat source unit (20).

The heat source control unit (23) includes, for example, a processor and a memory electrically connected to the processor and storing programs and information for operating the processor. Various functions of the heat source control unit (23) are achieved in such a manner that the processor executes the programs.

[Utilization Circuit]

Each utilization circuit (31) includes a utilization heat exchanger (70) and a utilization expansion valve (75). Each utilization circuit (31) also includes first and second utilization passages (P31, P32). The first and second utilization passages (P31, P32) each include, for example, a refrigerant pipe.

<Utilization Fan>

Each utilization fan (32) is disposed near the corresponding utilization heat exchanger (70) and is configured to provide utilization air to the utilization heat exchanger (70). In this example, the utilization air is indoor air.

<Utilization Heat Exchanger>

Each utilization heat exchanger (70) is configured to cause the refrigerant flowing through the utilization heat exchanger (70) to exchange heat with the utilization air provided to the utilization heat exchanger (70). Each utilization heat exchanger (70) is, for example, a fin-and-tube heat exchanger.

Each first utilization passage (P31) connects a gas end of the corresponding utilization heat exchanger (70) and the gas connection passage (P11). Each second utilization passage (P32) connects a liquid end of the corresponding utilization heat exchanger (70) and the liquid connection passage (P12).

<Utilization Expansion Valve>

Each utilization expansion valve (75) is disposed on the corresponding second utilization passage (P32). Each utilization expansion valve (75) has an adjustable opening degree. Each utilization expansion valve (75) is, for example, an electric valve.

[Various Sensors in Utilization Unit]

Each of the utilization units (30) includes various sensors (not illustrated) such as a pressure sensor and a temperature sensor. Examples of physical quantities to be detected by these various sensors may include, but not limited to, a pressure and a temperature of the high-pressure refrigerant in the refrigerant circuit (11), a pressure and a temperature of the low-pressure refrigerant in the refrigerant circuit (11), a pressure and a temperature of the refrigerant in the corresponding utilization heat exchanger (70), and a temperature of air to be sucked into the corresponding utilization unit (30). The various sensors each transmit a detection signal indicating a detection result to the corresponding utilization control unit (33).

[Utilization Control Unit]

Each utilization control unit (33) is connected to the various sensors of the corresponding utilization unit (30) and the respective constituent elements of the utilization unit (30), through communication lines. As illustrated in FIG. 2, each utilization control unit (33) is connected to the corresponding utilization expansion valve (75), the corresponding utilization fan (32), and the like. Each utilization control unit (33) receives an external signal transmitted outside the corresponding utilization unit (30). Each utilization control unit (33) controls the respective constituent elements of the corresponding utilization unit (30), based on the detection signals from the various sensors of the utilization unit (30) and the external signal transmitted outside the utilization unit (30).

Each utilization control unit (33) includes, for example, a processor and a memory electrically connected to the processor and storing programs and information for operating the processor. Various functions of the utilization control unit (33) are achieved in such a manner that the processor executes the programs.

[Refrigerant Circuit]

As described above, the refrigerant circuit (11) is constituted of the heat source circuit (21) of the heat source unit (20) and the utilization circuit (31) of each utilization unit (30) that are connected to each other. The refrigerant circuit (11) includes a plurality of heat exchangers (12). In this example, the plurality of heat exchangers (12) include a heat source heat exchanger (50) in the heat source circuit (21) of the heat source unit (20) and utilization heat exchangers (70) in the utilization circuits (31) of the two utilization units (30). The refrigerant circuit (11) also includes, in addition to the plurality of heat exchangers (12), the constituent elements of the heat source circuit (21), such as the receiver (60), the degassing passage (61), the degassing valve (62), and the heat source expansion valve (65), and the constituent elements of each utilization circuit (31), such as the utilization expansion valve (75).

[Control Unit]

In the refrigeration system (10), the heat source control unit (23) and the plurality of utilization control units (33) constitute a control unit (15). As illustrated in FIG. 2, specifically, the heat source control unit (23) and the utilization control units (33) are connected to each other through communication lines. The control unit (15) controls the respective constituent elements of the refrigeration system (10), based on detection signals from the various sensors in the refrigeration system (10) and external signals transmitted outside the refrigeration system (10). The action of the refrigeration system (10) is thus controlled.

In this example, of the heat source control unit (23) and the plurality of utilization control units (33), the heat source control unit (23) mainly controls the respective constituent elements of the refrigeration system (10). Specifically, the heat source control unit (23) controls the respective constituent elements of the heat source unit (20), and controls each utilization control unit (33), thereby controlling the respective constituent elements of the corresponding utilization unit (30). The heat source control unit (23) thus controls the respective constituent elements of the refrigeration system (10).

[Operations and Actions]

In the refrigeration system (10) according to the first embodiment, a simple cooling operation is implemented. During the simple cooling operation, the utilization units (30) operate to cool the air in the room.

<States of Constituent Elements in Refrigeration System>

During the simple cooling operation, the compression element (40), the heat source fan (22), and the utilization fans (32) are driven.

<Action of Control Unit>

The control unit (15) adjusts the opening degree of the heat source expansion valve (65) in accordance with the pressure (RP) in the receiver (60). Specifically, the control unit (15) decreases the opening degree of the heat source expansion valve (65) as the pressure (RP) in the receiver (60) rises. The control unit (15) may fully open the heat source expansion valve (65) under normal circumstances and may decrease the opening degree of the heat source expansion valve (65) when the pressure (RP) in the receiver (60) rises. For example, the control unit (15) may maintain the heat source expansion valve (65) in the fully open state when the pressure (RP) in the receiver (60) does not take a value more than a threshold value set in advance and may decrease the opening degree of the heat source expansion valve (65) when the pressure (RP) in the receiver (60) takes a value more than the threshold value.

The control unit (15) adjusts the opening degrees of the utilization expansion valves (75) in the two utilization units (30) such that the degree of superheating of the refrigerant flowing out of each utilization heat exchanger (70) becomes equal to a target degree of superheating.

The control unit (15) performs receiver pressure control. The control unit (15) performs the receiver pressure control to control the degassing valve (62), based on the pressure (RP) in the receiver (60). The receiver pressure control will be described in detail later.

The pressure (RP) in the receiver (60) may be a pressure detected by the receiver pressure sensor (25) or may be a pressure derived based on a temperature detected by the receiver temperature sensor (26). In other words, the control unit (15) may derive the pressure (RP) in the receiver (60), based on a detection signal from the receiver pressure sensor (25) or may derive the pressure (RP) in the receiver (60), based on a detection signal from the receiver temperature sensor (26).

<Details of Refrigeration Cycle>

During the simple cooling operation, the heat source heat exchanger (50) of the heat source unit (20) functions as a radiator while the utilization heat exchangers (70) of the two utilization units (30) function as evaporators. The refrigerant flows from the heat source heat exchanger (50) into the receiver (60) via the heat source expansion valve (65). The refrigerant then flows from the receiver (60) into the two utilization heat exchangers (70) via the two utilization expansion valves (75).

Specifically, the refrigerant is discharged from the compression element (40) of the heat source unit (20). The refrigerant then dissipates heat in the heat source heat exchanger (50). The refrigerant then flows out of the heat source heat exchanger (50). The refrigerant is then decompressed by the heat source expansion valve (65). The refrigerant then flows into the receiver (60). The refrigerant then flows out of the heat source unit (20) through the liquid outlet of the receiver (60). The refrigerant is then diverted toward the two utilization units (30) via the liquid connection passage (P12). The refrigerant then flows into each utilization unit (30). The refrigerant is then decompressed by the corresponding utilization expansion valve (75). The refrigerant then evaporates in the corresponding utilization heat exchanger (70). The indoor air is thus cooled. The refrigerant then flows out of each utilization heat exchanger (70). The refrigerant then passes through the gas connection passage (P11). The refrigerant is then sucked into and compressed by the compression element (40) of the heat source unit (20).

It should be noted that the simple cooling operation is an example of a first operation. During the first operation, one of the plurality of heat exchangers (12) functions as a radiator while two of the plurality of heat exchangers (12) function as evaporators. The refrigerant flows from the heat exchanger (12) functioning as a radiator into the receiver (60). The refrigerant then flows from the receiver (60) into the two heat exchangers (12) functioning as evaporators. The heat source heat exchanger (50) is an example of the heat exchanger (12) functioning as a radiator during the first operation. The utilization heat exchangers (70) are examples of the heat exchangers (12) functioning as evaporators during the first operation.

The simple cooling operation is also an example of a cooling operation. During the cooling operation, the heat source heat exchanger (50) functions as a radiator while each utilization heat exchanger (70) functions as an evaporator. The refrigerant flows from the heat source heat exchanger (50) into the receiver (60) via the heat source expansion valve (65). The refrigerant then flows from the receiver (60) into each utilization heat exchanger (70).

[Drift of Refrigerant]

In the simple cooling operation which is an example of the first operation, the refrigerant in a supercritical state flows into the receiver (60), depending on operating conditions, so that the pressure (RP) in the receiver (60) possibly exceeds the critical pressure of the refrigerant. For example, in a case where the pressure of the refrigerant in the heat source heat exchanger (50) rises since, for example, the temperature of the heat source air provided to the heat source heat exchanger (50) is high, the refrigerant in the supercritical state possibly flows into the receiver (60). If the pressure (RP) in the receiver (60) exceeds the critical pressure of the refrigerant, the refrigerant in the receiver (60) is less likely to be separated into the refrigerant in the gas state and the refrigerant in the liquid state. As a result, the refrigerant flowing from the receiver (60) into each utilization heat exchanger (70) functioning as an evaporator is less likely to become the liquid refrigerant. Consequently, the refrigerant possibly drifts in each utilization heat exchanger (70) functioning as an evaporator.

For example, the refrigerant in the supercritical state tends to become larger in specific volume than the refrigerant in the liquid state, and tends to become greater in pressure loss at a flow path than the refrigerant in the liquid state. In the case where the refrigerant in the supercritical state flows from the receiver (60) into each utilization heat exchanger (70) functioning as an evaporator, therefore, the refrigerant in the supercritical state is greater than the refrigerant in the liquid state in variability of pressure loss at the flow paths extending from the receiver (60) to the plurality of utilization heat exchangers (70). Consequently, the refrigerant possibly drifts in each utilization heat exchanger (70). Specifically, of the flow paths extending from the receiver (60) to the plurality of utilization heat exchangers (70), the refrigerant easily flows through the flow path with relatively small pressure loss, whereas the refrigerant hardly flows through the flow path with relatively large pressure loss.

[Receiver Pressure Control]

Figure 3:
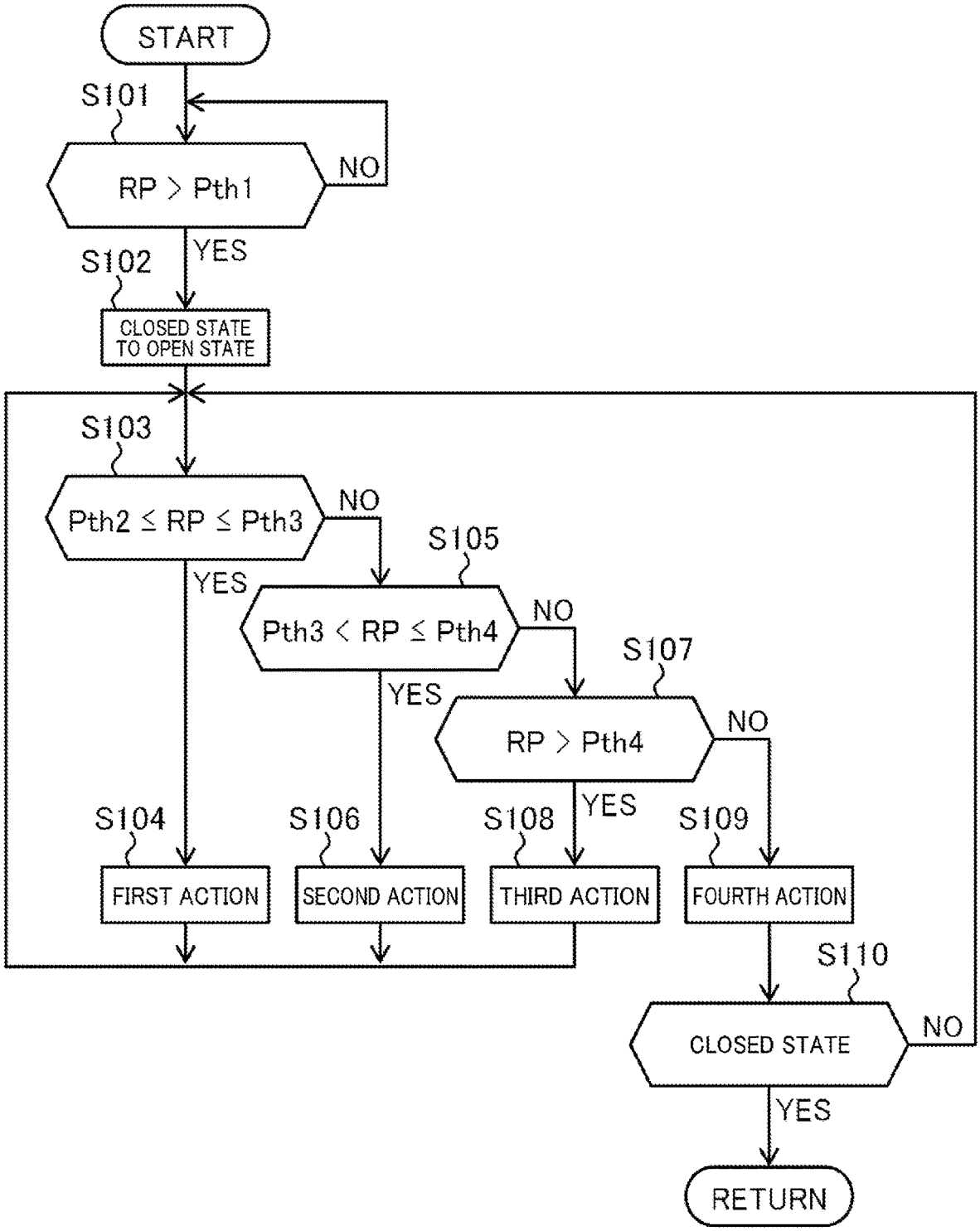
FIG. 3 is a flowchart of receiver pressure control.

With reference to FIG. 3, next, a description will be given of the receiver pressure control. The control unit (15) carries out the following steps in the first operation.

<Step (S101)>

The control unit (15) determines whether the pressure (RP) in the receiver (60) exceeds a first pressure (Pth1) set in advance. The first pressure (Pth1) is equal to or lower than the critical pressure of the refrigerant. In this example, the first pressure (Rth1) is lower than the critical pressure of the refrigerant. The first pressure (Pth1) is set at, for example, 6.8 MPa. When the pressure (RP) in the receiver (60) exceeds the first pressure (Pth1), the control unit (15) executes processing in step (S102).

<Step (S102)>

When the pressure (RP) in the receiver (60) exceeds the first pressure (Pth1), the control unit (15) changes the degassing valve (62) from the closed state to the open state. For example, the control unit (15) changes the opening degree of the degassing valve (62) to an initial opening degree set in advance (e.g., a minimum opening degree). The control unit (15) then executes processing in step (S103).

<Step (S103)>

The control unit (15) determines whether the pressure (RP) in the receiver (60) falls within a range from a second pressure (Pth2) to a third pressure (Pth3). In the following description, the range from the second pressure (Pth2) to the third pressure (Pth3) is referred to as "a first range". The second pressure (Pth2) is lower than the first pressure (Pth1). The third pressure (Pth3) is higher than the first pressure (Pth1). In addition, the third pressure (Pth3) is equal to or lower than the critical pressure of the refrigerant. The second pressure (Pth2) is set at, for example, 6.7 MPa. The third pressure (Pth3) is set at, for example, 6.9 MPa.

When the pressure (RP) in the receiver (60) falls within the first range, the control unit (15) executes processing in step (S104). When the pressure (RP) in the receiver (60) does not fall within the first range, the control unit (15) executes processing in step (S105).

<Step (S104)>

When the pressure (RP) in the receiver (60) falls within the first range, the control unit (15) performs a first action. By the first action, the control unit (15) adjusts the opening degree of the degassing valve (62) such that the pressure (RP) in the receiver (60) becomes equal to a target pressure set in advance. It should be noted that the target pressure is a pressure that is set in advance within the first range, and is equal to or lower than the critical pressure of the refrigerant. In this example, the target pressure is lower than the critical pressure of the refrigerant. The target pressure is set at, for example, 6.8 MPa which is a median value of the first range. In this example, the target pressure is identical to the first pressure (Pth1). The control unit (15) then executes the processing in step (S103).

In this example, the control unit (15) performs the first action to derive an amount of change in opening degree, based on a difference between the pressure (RP) in the receiver (60) and the target pressure and to change the opening degree of the degassing valve (62), based on the amount of change in opening degree thus derived.

Specifically, when a pressure difference obtained by subtracting the target pressure from the pressure (RP) in the receiver (60) takes a positive value, the amount of change in opening degree has a "positive" sign. The positive amount of change in opening degree takes a larger absolute value as the difference between the pressure (RP) in the receiver (60) and the target pressure becomes larger. The control unit (15) increases the opening degree of the degassing valve (62) as the absolute value of the positive amount of change in opening degree is large.

On the other hand, when the pressure difference obtained by subtracting the target pressure from the pressure (RP) in the receiver (60) takes a negative value, the amount of change in opening degree has a "negative" sign. The negative amount of change in opening degree takes a larger absolute value as the difference between the pressure (RP) in the receiver (60) and the target pressure becomes larger. The control unit (15) decreases the opening degree of the degassing valve (62) as the absolute value of the negative amount of change in opening degree is large.

As described above, the positive amount of change in opening degree indicates an amount of increase in opening degree of the degassing valve (62), and the negative amount of change in opening degree indicates an amount of decrease in opening degree of the degassing valve (62). In the following description, the positive amount of change in opening degree is referred to as "an amount of increase in opening degree" and the negative amount of change in opening degree is referred to as "an amount of decrease in opening degree".

Also in this example, the control unit (15) performs the first action to adjust the opening degree of the degassing valve (62) by PID control. Specifically, the control unit (15) derives the amount of change in opening degree, based on a proportion, an integral, and a derivative of the difference between the pressure (RP) in the receiver (60) and the target pressure.

Also in this example, the control unit (15) performs the first action to set an upper limit and a lower limit for the amount of change in opening degree. In a case where the amount of change in opening degree is represented by a pulse (pls), the upper limit for the amount of change in opening degree is set at, for example, "+10 pls", and the lower limit for the amount of change in opening degree is set at, for example, "−10 pls".

<Step (S105)>

When the pressure (RP) in the receiver (60) does not fall within the first range, the control unit (15) determines whether the pressure (RP) in the receiver (60) falls within a range from the third pressure (Pth3) to a fourth pressure (Pth4). In the following description, the range from the third pressure (Pth3) to the fourth pressure (Pth4) is referred to as "a second range". The fourth pressure (Pth4) is higher than the third pressure (Pth3). The fourth pressure (Pth4) may be higher than the critical pressure of the refrigerant. In this example, the fourth pressure (Pth4) is lower than the working pressure at the pressure release valve (66). For example, when the working pressure at the pressure release valve (66) is 8.4 MPa, the fourth pressure (Pth4) is set at 8.3 MPa.

When the pressure (RP) in the receiver (60) falls within the second range, the control unit (15) executes processing in step (S106). When the pressure (RP) in the receiver (60) does not fall within the second range, the control unit (15) executes processing in step (S107).

<Step (S106)>

When the pressure (RP) in the receiver (60) falls within the second range, the control unit (15) performs a second action. The control unit (15) performs the second action to increase the opening degree of the degassing valve (62) as the pressure (RP) in the receiver (60) rises. The control unit (15) then executes the processing in step (S103).

In this example, the control unit (15) performs the second action to derive an amount of increase in opening degree (a positive amount of change in opening degree), based on a difference between the pressure (RP) in the receiver (60) and the target pressure such that the amount of increase in opening degree increases as the difference between the pressure (RP) in the receiver (60) and the target pressure increases. This target pressure is a target pressure (e.g., 6.8 MPa) set in advance within the first range. The control unit (15) increases the opening degree of the degassing valve (62), based on the amount of increase in opening degree.

Also in this example, the control unit (15) performs the second action to adjust the opening degree of the degassing valve (62) by P control (proportional control). Specifically, the control unit (15) derives the amount of increase in opening degree, based on a proportion of the difference between the pressure (RP) in the receiver (60) and the target pressure. The amount of increase in opening degree increases in proportion to the difference between the pressure (RP) in the receiver (60) and the target pressure.

Also in this example, the control unit (15) performs the second action to set an upper limit and a lower limit for the amount of change in opening degree. In the case where the amount of change in opening degree is represented by a pulse (pls), the upper limit for the amount of change in opening degree is set at, for example, "+20 pls", and the lower limit for the amount of change in opening degree is set at, for example, "0 pls". The upper limit value for the amount of change in opening degree by the second action is larger than the upper limit value for the amount of change in opening degree by the first action. The lower limit value for the amount of change in opening degree by the second action is larger than the lower limit value for the amount of change in opening degree by the first action.

<Step (S107)>

When the pressure (RP) in the receiver (60) does not fall within the second range, the control unit (15) determines whether the pressure (RP) in the receiver (60) exceeds the fourth pressure (Pth4). When the pressure (RP) in the receiver (60) exceeds the fourth pressure (Pth4), the control unit (15) executes processing in step (S108). When the pressure (RP) in the receiver (60) does not exceed the fourth pressure (Pth4), the control unit (15) executes processing in step (S109).

<Step (S108)>

When the pressure (RP) in the receiver (60) exceeds the fourth pressure (Pth4), the control unit (15) performs a third action. The control unit (15) performs the third action to change the opening degree of the degassing valve (62) to a maximum opening degree set in advance. The control unit (15) then executes the processing in step (S103).

It should be noted that the maximum opening degree is larger than the initial opening degree described above. The maximum opening degree is set at, for example, an opening degree having a value that is equal to or more than the maximum value of the opening degree of the degassing valve (62) in the case where the pressure (RP) in the receiver (60) falls within the second range. Specifically, the maximum opening degree may be an opening degree in a state in which the degassing valve (62) is fully opened. The maximum opening degree may alternatively be an opening degree that is smaller than the opening degree in the state in which the degassing valve (62) is fully opened. In a case where the opening degree of the degassing valve (62) is represented by a pulse (pls), the maximum opening degree is set at, for example, "480 pls".

<Step (S109)>

When the pressure (RP) in the receiver (60) does not fall within the first range, does not fall within the second range, and does not exceed the fourth pressure (Pth4), the pressure (RP) in the receiver (60) falls short of the second pressure (Pth2) which is the lower limit value of the first range. When the pressure (RP) in the receiver (60) falls short of the second pressure (Pth2), the control unit (15) performs a fourth action. The control unit (15) performs the fourth action to decrease the opening degree of the degassing valve (62) as the pressure (RP) in the receiver (60) reduces.

In this example, the control unit (15) performs the fourth action to derive an amount of decrease in opening degree (a negative amount of change in opening degree), based on a difference between the pressure (RP) in the receiver (60) and the target pressure such that the amount of decrease in opening degree increases as the difference between the pressure (RP) in the receiver (60) and the target pressure increases. This target pressure is a target pressure (e.g., 6.8 MPa) set in advance within the first range. The control unit (15) decreases the opening degree of the degassing valve (62), based on the amount of decrease in opening degree.

Also in this example, the control unit (15) performs the fourth action to adjust the opening degree of the degassing valve (62) by P control (proportional control). Specifically, the control unit (15) derives the amount of decrease in opening degree, based on a proportion of the difference between the pressure (RP) in the receiver (60) and the target pressure. The amount of decrease in opening degree increases in proportion to the difference between the pressure (RP) in the receiver (60) and the target pressure.

Also in this example, the control unit (15) performs the fourth action to set an upper limit and a lower limit for the amount of change in opening degree. In the case where the amount of change in opening degree is represented by a pulse (pls), the upper limit for the amount of change in opening degree is set at, for example, "0 pls", and the lower limit for the amount of change in opening degree is set at, for example, "−20 pls". The upper limit value for the amount of change in opening degree by the fourth action is smaller than the upper limit value for the amount of change in opening degree by the first action. The lower limit value for the amount of change in opening degree by the fourth action is smaller than the lower limit value for the amount of change in opening degree by the first action.

<Step (S110)>

Next, the control unit (15) determines whether the degassing valve (62) is in the closed state. When the degassing valve (62) is in the closed state, the control unit (15) executes the processing in step (S101). When the degassing valve (62) is not in the closed state, the control unit (15) executes the processing in step (S103).

[Advantageous Effects of First Embodiment]

As described above, the refrigeration system (10) according to the first embodiment implements the first operation (the simple cooling operation) during which one of the plurality of heat exchangers (12) (i.e., the heat source heat exchanger (50)) functions as a radiator while two of the plurality of heat exchangers (12) (i.e., the utilization heat exchangers (70)) function as evaporators, and the refrigerant flows from the heat exchanger (12) functioning as a radiator into the receiver (60) and then flows from the receiver (60) into each of the two heat exchangers (12) functioning as evaporators. The control unit (15) changes the degassing valve (62) from the closed state to the open state when the pressure (RP) in the receiver (60) exceeds the first pressure (Pth1) in the first operation.

According to this configuration, when the degassing valve (62) is changed from the closed state to the open state, the pressure (RP) in the receiver (60) can be reduced in such a manner that the refrigerant in the gas state is discharged from the receiver (60) via the degassing passage (61). This configuration is capable of reducing the pressure (RP) in the receiver (60) to be lower than the critical pressure of the refrigerant. This configuration is therefore capable of separating the refrigerant in the receiver (60) into the refrigerant in the gas state and the refrigerant in the liquid state. This configuration is also capable of causing the liquid refrigerant to flow from the receiver (60) into each heat exchanger (12) functioning as an evaporator. This configuration is thus capable of inhibiting the drift of the refrigerant in each heat exchanger (12) functioning as an evaporator (i.e., each utilization heat exchanger (70)) during the first operation.

Also in the refrigeration system (10) according to the first embodiment, in the first operation, when the pressure (RP) in the receiver (60) falls within the first range from the second pressure (Pth2) to the third pressure (Pth3), the control unit (15) adjusts the opening degree of the degassing valve (62) such that the pressure (RP) in the receiver (60) becomes equal to the target pressure.

According to this configuration, the pressure (RP) in the receiver (60) can be made equal to the target pressure when the pressure (RP) in the receiver (60) falls within the first range. It should be noted that the target pressure is equal to or lower than the critical pressure of the refrigerant. This configuration is therefore capable of reducing the pressure (RP) in the receiver (60) to be lower than the critical pressure of the refrigerant. This configuration is thus capable of inhibiting the drift of the refrigerant in each heat exchanger (12) functioning as an evaporator.

Also in the refrigeration system (10) according to the first embodiment, in the first operation, when the pressure (RP) in the receiver (60) falls within the second range from the third pressure (Pth3) to the fourth pressure (Pth4), the control unit (15) increases the opening degree of the degassing valve (62) as the pressure (RP) in the receiver (60) rises.

According to this configuration, the pressure (RP) in the receiver (60) reduces as the opening degree of the degassing valve (62) increases. This configuration is therefore capable of, when the pressure (RP) in the receiver (60) falls within the second range higher than the first range, increasing the opening degree of the degassing valve (62) as the pressure (RP) in the receiver (60) rises, thereby bringing the pressure (RP) in the receiver (60) close to the first range. This configuration is thus capable of causing the pressure (RP) in the receiver (60) to fall within the first range and achieving the control (first action) to make the pressure (RP) in the receiver (60) equal to the target pressure.

Also in the refrigeration system (10) according to the first embodiment, in the first operation, when the pressure (RP) in the receiver (60) is higher than the fourth pressure (Pth4), the control unit (15) maintains the opening degree of the degassing valve (62) at a maximum opening degree set in advance.

According to this configuration, when the pressure (RP) in the receiver (60) is higher than the fourth pressure (Pth4) corresponding to the upper limit of the second range, the pressure (RP) in the receiver (60) can be promptly reduced in such a manner that the opening degree of the degassing valve (62) is maintained at the maximum opening degree. This configuration is therefore capable of inhibiting an excessive rise in the pressure (RP) in the receiver (60) and also inhibiting occurrence of an abnormal situation of the pressure in the receiver (60).

Also in the refrigeration system (10) according to the first embodiment, in the first operation, when the pressure (RP) in the receiver (60) is lower than the second pressure (Pth2), the control unit (15) decreases the opening degree of the degassing valve (62) as the pressure (RP) in the receiver (60) reduces.

According to this configuration, the pressure (RP) in the receiver (60) rises as the opening degree of the degassing valve (62) decreases. This configuration is therefore capable of, when the pressure (RP) in the receiver (60) is lower than the second pressure (Pth2) corresponding to the lower limit of the first range, decreasing the opening degree of the degassing valve (62) as the pressure (RP) in the receiver (60) reduces, thereby bringing the pressure (RP) in the receiver (60) close to the first range. This configuration is thus capable of causing the pressure (RP) in the receiver (60) to fall within the first range and achieving the control (first action) to make the pressure (RP) in the receiver (60) equal to the target pressure.

Modifications of First Embodiment

The refrigeration system (10) according to the first embodiment may include three or more utilization units (30). The heat source unit (20) according to the first embodiment may include two or more heat source heat exchangers (50). For example, during the simple cooling operation which is an example of the first operation, two or more heat source heat exchangers (50) may function as radiators while three or more utilization heat exchangers (70) may function as evaporators.

The refrigerant circuit (11) according to the first embodiment may include another heat exchanger (12) in addition to the heat source heat exchanger (50) and the utilization heat exchangers (70). In other words, the plurality of heat exchangers (12) in the refrigerant circuit (11) according to the first embodiment may include another heat exchanger (12) in addition to the heat source heat exchanger (50) and the utilization heat exchangers (70).

The foregoing description concerns the case where the utilization units (30) are installed in the room; however, the present disclosure is not limited to this case. For example, the utilization units (30) may be installed in a refrigeration facility such as a refrigerator, a freezer, or a showcase. The utilization units (30) installed in the refrigeration facility are configured to cool air inside the refrigeration facility. In the case where the plurality of utilization units (30) in the refrigeration system (10) according to the first embodiment are installed in the refrigeration facility, the refrigeration system (10) is configured to implement a refrigeration-facility operating operation. During the refrigeration-facility operating operation, the utilization units (30) operate to cool the air inside the refrigeration facility. The refrigeration-facility operating operation is an example of the first operation and is also an example of the cooling operation.

Second Embodiment

Figure 4:
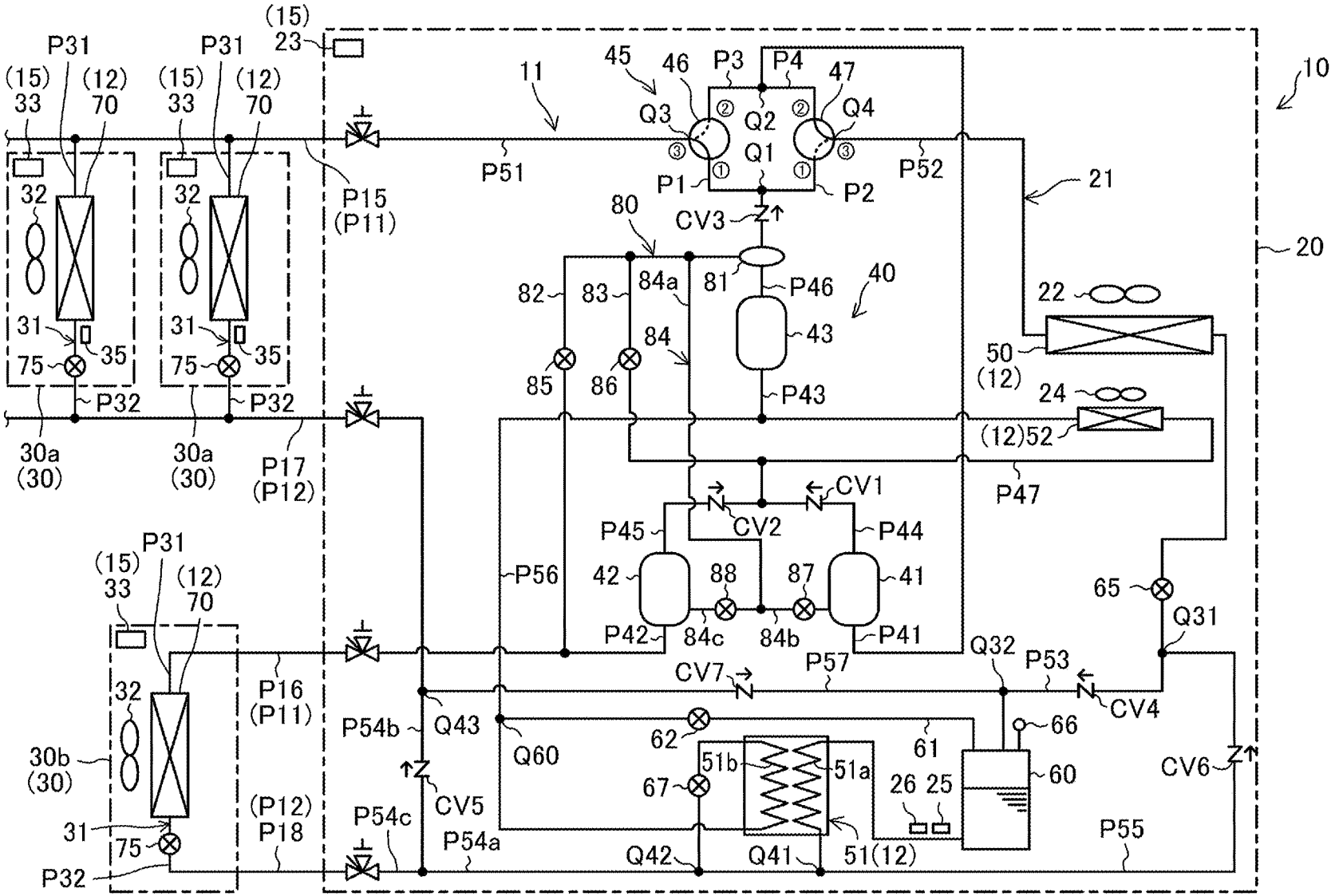
FIG. 4 is a diagram of a piping system as an exemplary configuration of a refrigeration system according to a second embodiment.

FIG. 4 illustrates a configuration of a refrigeration system (10) according to a second embodiment. The refrigeration system (10) according to the second embodiment is configured to condition air in a room and to cool air inside a refrigeration facility. A plurality of utilization units (30) according to the second embodiment include an indoor unit (30*a*) installed in the room and a refrigeration facility unit (30*b*) installed in the refrigeration facility. In this example, the refrigeration system (10) includes two indoor units (30*a*) and one refrigeration facility unit (30*b*).

A heat source unit (20) according to the second embodiment includes a cooling fan (24) in addition to the constituent elements of the heat source unit (20) according to the first embodiment. Each indoor unit (30*a*) includes a refrigerant temperature sensor (35) in addition to the constituent elements of each utilization unit (30) according to the first embodiment. The refrigeration facility unit (30*b*) is similar in configuration to the utilization units (30) according to the first embodiment.

In the second embodiment, similarly to the first embodiment, the heat source circuit (21) of the heat source unit (20) and the utilization circuits (31) of the utilization units (30) are connected to constitute a refrigerant circuit (11). Specifically, a gas connection passage (P11) includes a first gas connection passage (P15) and a second gas connection passage (P16). A liquid connection passage (P12) includes a first liquid connection passage (P17) and a second liquid connection passage (P18). The heat source circuit (21) has two gas ends respectively connected to the first connection passage (P15) and the second gas connection passage (P16). The heat source circuit (21) also has two liquid ends respectively connected to the first liquid connection passage (P17) and the second liquid connection passage (P18). In each indoor unit (30*a*), the utilization circuit (31) has a gas end connected to the first gas connection passage (P15) and a liquid end connected to the first liquid connection passage (P17). In the refrigeration facility unit (30*b*), the utilization circuit (31) has a gas end connected to the second gas connection passage (P16) and a liquid end connected to the second liquid connection passage (P18).

[Heat Source Circuit]

The heat source circuit (21) according to the second embodiment includes a flow path switching mechanism (45), a cooling heat exchanger (51), an intermediate cooler (52), and a cooling expansion valve (67) in addition to the constituent elements of the heat source circuit (21) according to the first embodiment. The heat source circuit (21) also includes first to seventh passages (P51 to P57) in place of the first to fourth heat source passages (P21 to P24) illustrated in FIG. 1. The first to seventh passages (P51 to P57) each include, for example, a refrigerant pipe.

<Compression Element>

The compression element (40) includes a first compressor (41), a second compressor (42), and a third compressor (43). Each of the first to third compressors (41 to 43) is similar in configuration to the compressor in the compression element (40) according to the first embodiment. The compression element (40) is of a two-stage compression type. The first compressor (41) and the second compressor (42) constitute a lower stage-side compressor while the third compressor (43) constitutes a higher stage-side compressor. The first compressor (41) is provided for the indoor units (30*a*), and the second compressor (42) is provided for the refrigeration facility unit (30*b*).

The compression element (40) also includes first to third suction passages (P41 to P43), first to third discharge passages (P44 to P46), and an intermediate passage (P47). The first to third suction passages (P41 to P43), the first to third discharge passages (P44 to P46), and the intermediate passage (P47) each include, for example, a refrigerant pipe.

The first to third compressors (41 to 43) have suction ports respectively connected to first ends of the first to third suction passages (P41 to P43). The first to third compressors (41 to 43) have discharge ports respectively connected to first ends of the first to third discharge passages (P44 to P46). The first suction passage (P41) has a second end connected to a second port (Q2) of the flow path switching mechanism (45) which will be described later. The second suction passage (P42) has a second end connected to a first end of the second gas connection passage (P16). The third suction passage (P43) has a second end connected to a second end of the first discharge passage (P44) and a second end of the second discharge passage (P45) via the intermediate passage (P47). The third discharge passage (P46) has a second end connected to a first port (Q1) of the flow path switching mechanism (45) which will be described later.

<Flow Path Switching Mechanism>

The flow path switching mechanism (45) has the first port (Q1), the second port (Q2), a third port (Q3), and a fourth port (Q4), and switches communication states of the first to fourth ports (Q1 to Q4).

In this example, the flow path switching mechanism (45) includes a first three-way valve (46) and a second three-way valve (47). The flow path switching mechanism (45) also includes first to fourth switching passages (P1 to P4). The first to fourth switching passages (P1 to P4) each include, for example, a refrigerant pipe.

The first three-way valve (46) has first to third ports and switches between a first state in which the first port and the third port communicate with each other (a state indicated by a solid line in FIG. 4) and a second state in which the second port and the third port communicate with each other (a state indicated by a broken line in FIG. 4). The second three-way valve (47) is similar in configuration to the first three-way valve (46). The second three-way valve (47) switches between a first state in which a first port and a third port communicate with each other (a state indicated by a broken line in FIG. 4) and a second state in which a second port and the third port communicate with each other (a state indicated by a solid line in FIG. 4).

The first switching passage (P1) connects the first port of the first three-way valve (46) and the second end of the third discharge passage (P46). The second switching passage (P2) connects the first port of the second three-way valve (47) and the second end of the third discharge passage (P46). The third switching passage (P3) connects the second port of the first three-way valve (46) and the second end of the first suction passage (P41). The fourth switching passage (P4) connects the second port of the second three-way valve (47) and the second end of the first suction passage (P41). The first passage (P51) connects the third port of the first three-way valve (46) and a first end of a first gas connection passage (P15). The second passage (P52) connects the third port of the second three-way valve (47) and the gas end of the heat source heat exchanger (50).

In this example, the first port (Q1) is constituted of a connection portion of the first switching passage (P1), the second switching passage (P2), and the third discharge passage (P46). The second port (Q2) is constituted of a connection portion of the third switching passage (P3), the fourth switching passage (P4), and the first suction passage (P41). The third port (Q3) is constituted of the third port of the first three-way valve (46). The fourth port (Q4) is constituted of the third port of the second three-way valve (47).

<Heat Source Heat Exchanger>

The heat source heat exchanger (50) according to the second embodiment is similar in configuration to the heat source heat exchanger (50) according to the first embodiment.

<Receiver>

The receiver (60) according to the second embodiment is similar in configuration to the receiver (60) according to the first embodiment.

<First to Seventh Passages>

The first passage (P51) connects the third port (Q3) of the flow path switching mechanism (45) and a first end of the first gas connection passage (P15). The second passage (P52) connects the fourth port (Q4) of the flow path switching mechanism (45) and the gas end of the heat source heat exchanger (50). The third passage (P53) connects the liquid end of the heat source heat exchanger (50) and an inlet of the receiver (60). The fourth passage (P54) connects a liquid outlet of the receiver (60) and a first end of the liquid connection passage (P12). Specifically, the fourth passage (P54) includes a main passage (P54*a*), a first branch passage (P54*b*), and a second branch passage (P54*c*). The main passage (P54*a*) has a first end connected to the liquid outlet of the receiver (60). The first branch passage (P54*b*) has a first end connected to a second end of the main passage (P54*a*). The second branch passage (P54*c*) has a first end connected to the second end of the main passage (P54*a*). The first branch passage (P54*b*) has a second end connected to a first end of the first liquid connection passage (P17). The second branch passage (P54*c*) has a second end connected to a first end of the second liquid connection passage (P18).

The fifth passage (P55) connects a first midway portion (Q31) of the third passage (P53) and a first midway portion (Q41) of the fourth passage (P54). The first midway portion (Q41) of the fourth passage (P54) is located on the main passage (P54*a*) of the fourth passage (P54). The sixth passage (P56) connects a second midway portion (Q42) of the fourth passage (P54) and the second end of the third suction passage (P43). The second midway portion (Q42) of the fourth passage (P54) is located on the main passage (P54*a*) of the fourth passage (P54). The second midway portion (Q42) of the fourth passage (P54) is also located between the first midway portion (Q41) of the fourth passage (P54) and the second end of the main passage (P54*a*) (i.e., a connection portion of the main passage (P54*a*), the first branch passage (P54*b*), and the second branch passage (P54*c*)). The seventh passage (P57) connects a second midway portion (Q32) of the third passage (P53) and a third midway portion (Q43) of the fourth passage (P54). The second midway portion (Q32) of the third passage (P53) is located between the first midway portion (Q31) and the receiver (60) on the third passage (P53). The third midway portion (Q43) of the fourth passage (P54) is located on the first branch passage (P54*b*) of the fourth passage (P54).

<Degassing Passage>

A degassing passage (61) according to the second embodiment has a first end connected to a gas outlet of the receiver (60). The degassing passage (61) according to the second embodiment has a second end connected to a midway portion (Q60) of the sixth passage (P56).

<Degassing Valve>

A degassing valve (62) according to the second embodiment is similar in configuration to the degassing valve (62) according to the first embodiment. The degassing valve (62) is disposed on the degassing passage (61).

<Heat Source Expansion Valve>

A heat source expansion valve (65) according to the second embodiment is similar in configuration to the heat source expansion valve (65) according to the first embodiment. The heat source expansion valve (65) is disposed on the third passage (P53) and between the heat source heat exchanger (50) and the first midway portion (Q31) of the third passage (P53).

<Pressure Release Valve>

A pressure release valve (66) according to the second embodiment is similar in configuration to the pressure release valve (66) according to the first embodiment. The pressure release valve (66) is disposed on the receiver (60).

<Cooling Heat Exchanger>

The cooling heat exchanger (51) is connected to the fourth passage (P54) and the sixth passage (P56) and is configured to cause the refrigerant flowing through the fourth passage (P54) to exchange heat with the refrigerant flowing through the sixth passage (P56).

In this example, the cooling heat exchanger (51) includes a first refrigerant passage (51*a*) incorporated in the fourth passage (P54), and a second refrigerant passage (51*b*) incorporated in the sixth passage (P56). The first refrigerant passage (51*a*) is disposed between the receiver (60) and the first midway portion (Q41) on the fourth passage (P54). The second refrigerant passage (51*b*) is disposed on the sixth passage (P56) and between the first end of the sixth passage (P56) (i.e., the second midway portion (Q42) of the fourth passage (P54)) and the midway portion (Q60) of the sixth passage (P56). The cooling heat exchanger (51) causes the refrigerant flowing through the first refrigerant passage (51*a*) to exchange heat with the refrigerant flowing through the second refrigerant passage (51*b*). The cooling heat exchanger (51) is, for example, a plate heat exchanger.

<Cooling Expansion Valve>

The cooling expansion valve (67) is disposed on the sixth passage (P56) and between the second midway portion (Q42) of the fourth passage (P54) and the cooling heat exchanger (51). The cooling expansion valve (67) has an adjustable opening degree. The cooling expansion valve (67) is, for example, an electric valve.

<Cooling Fan>

The cooling fan (24) is disposed near the intermediate cooler (52) and is configured to provide heat source air to the intermediate cooler (52). In this example, the heat source air is outdoor air.

<Intermediate Cooler>

The intermediate cooler (52) is disposed on the intermediate passage (P47) and is configured to cause the refrigerant flowing through the intermediate passage (P47) to exchange heat with the heat source air provided to the intermediate cooler (52). The refrigerant flowing through the intermediate passage (P47) is thus cooled. The intermediate cooler (52) is, for example, a fin-and-tube heat exchanger.

<Check Valve>

The heat source circuit (21) according to the second embodiment includes first to seventh check valves (CV1 to CV7). The first check valve (CV1) is disposed on the first discharge passage (P44). The second check valve (CV2) is disposed on the second discharge passage (P45). The third check valve (CV3) is disposed on the third discharge passage (P46).

The fourth check valve (CV4) is disposed on the third passage (P53) and between the first midway portion (Q31) and the second midway portion (Q32). The fifth check valve (CV5) is disposed on the first branch passage (P54*b*) of the fourth passage (P54) and between the first end of the fourth passage (P54) (i.e., a connection portion of the main passage (P54*a*), the first branch passage (P54*b*), and the second branch passage (P54*c*)) and the third midway portion (Q43) of the fourth passage (P54). The sixth check valve (CV6) is disposed on the fifth passage (P55). The seventh check valve (CV7) is disposed on the seventh passage (P57).

The first to seventh check valves (CV1 to CV7) each permit the flow of the refrigerant in a direction indicated by an arrow in FIG. 4 and prohibit the flow of the refrigerant in the opposite direction to the direction indicated by the arrow in FIG. 4.

<Oil Separation Circuit>

The heat source circuit (21) according to the second embodiment includes an oil separation circuit (80). The oil separation circuit (80) includes an oil separator (81), first to third oil return pipes (82 to 84), and first to fourth oil regulation valves (85 to 88).

The oil separator (81) is disposed on the third discharge passage (P46) and is configured to separate oil from the refrigerant discharged from the third compressor (43) of the compression element (40). The first oil return pipe (82) connects the oil separator (81) and a midway portion of the second suction passage (P42). The second oil return pipe (83) connects the oil separator (81) and a midway portion of the intermediate passage (P47). The third oil return pipe (84)

connects the oil separator (81) and oil reservoirs of the first and second compressors (41, 42). Specifically, the third oil return pipe (84) includes a main pipe (84*a*), a first branch pipe (84*b*), and a second branch pipe (84*c*). The main pipe (84*a*) has a first end connected to the oil separator (81). The first branch pipe (84*b*) and the second branch pipe (84*c*) each have a first end connected to a second end of the main pipe (84*a*). The first branch pipe (84*b*) has a second end connected to the oil reservoir of the first compressor (41). The second branch pipe (84*c*) has a second end connected to the oil reservoir of the second compressor (42).

The first oil regulation valve (85) is disposed on the first oil return pipe (82). The second oil regulation valve (86) is disposed on the second oil return pipe (83). The third oil regulation valve (87) is disposed on the first branch pipe (84*b*) of the third oil return pipe (84). The fourth oil regulation valve (88) is disposed on the second branch pipe (84*c*) of the third oil return pipe (84).

With this configuration, the oil separated by the oil separator (81) is returned to the second compressor (42) via the first oil return pipe (82). The oil separated by the oil separator (81) is also returned to the third compressor (43) via the second oil return pipe (83). The oil separated by the oil separator (81) is also returned to the oil reservoirs of the first and second compressors (41, 42) via the third oil return pipe (84).

[Various Sensors in Heat Source Unit]

The heat source unit (20) according to the second embodiment, which is similar to that according to the first embodiment, includes various sensors such as a pressure sensor and a temperature sensor. In this example, the various sensors of the heat source unit (20) include a receiver pressure sensor (25) and a receiver temperature sensor (26).

[Heat Source Control Unit]

Figure 5:
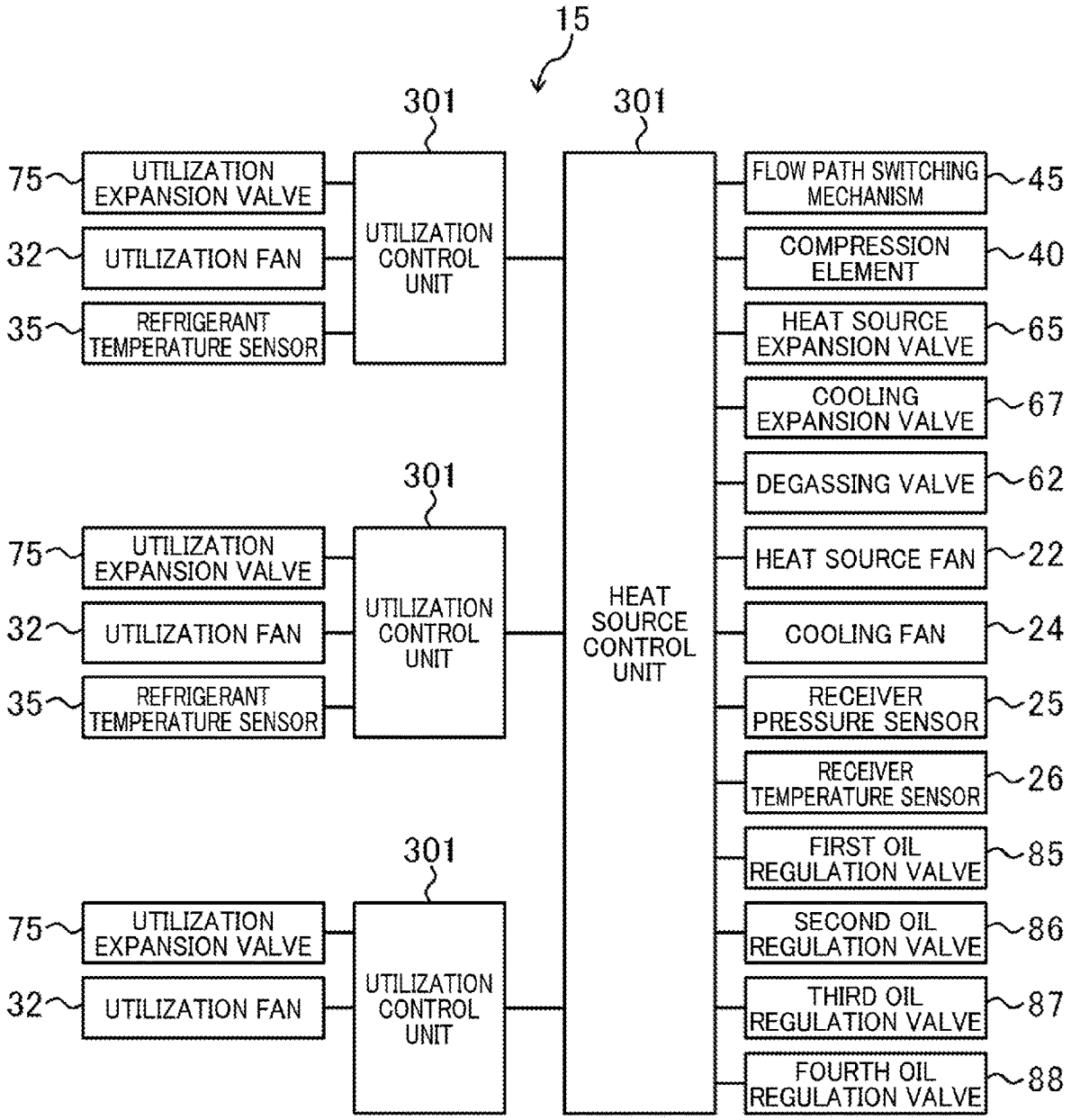
FIG. 5 is a block diagram of an exemplary configuration of a control unit according to the second embodiment.

The heat source control unit (23) according to the second embodiment is similar in configuration to the heat source control unit (23) according to the first embodiment. As illustrated in FIG. 5, the heat source control unit (23) according to the second embodiment is connected to the flow path switching mechanism (45), the compression element (40), the heat source expansion valve (65), the cooling expansion valve (67), the degassing valve (62), the heat source fan (22), the cooling fan (24), the receiver pressure sensor (25), the receiver temperature sensor (26), the first to fourth oil regulation valves (85 to 88), and the like. The heat source control unit (23) according to the second embodiment, which is similar to that according to the first embodiment, controls the respective constituent elements of the heat source unit (20), based on detection signals from the various sensors of the heat source unit (20) and an external signal transmitted outside the heat source unit (20).

[Utilization Circuit]

The utilization circuits (31) according to the second embodiment are similar in configuration to the utilization circuits (31) according to the first embodiment.

[Various Sensors in Utilization Unit]

Each utilization unit (30) according to the second embodiment, which is similar to that according to the first embodiment, includes various sensors such as a pressure sensor and a temperature sensor. In this example, the various sensors of each indoor unit (30*a*) include a refrigerant temperature sensor (35). The refrigerant temperature sensor (35) is disposed on the liquid side of the utilization heat exchanger (70) in each indoor unit (30*a*), and is configured, in a state in which the utilization heat exchanger (70) of the indoor unit (30*a*) functions as a radiator, to detect a temperature of the refrigerant flowing out of the utilization heat exchanger (70).

[Utilization Control Unit]

The utilization control units (33) according to the second embodiment are similar in configuration to the utilization control units (33) according to the first embodiment. As illustrated in FIG. 5, the utilization control unit (33) of each indoor unit (30*a*) is connected to the utilization expansion valve (75), the utilization fan (32), the refrigerant temperature sensor (35), and the like. The utilization control unit (33) of the refrigeration facility unit (30*b*) is connected to the utilization expansion valve (75), the utilization fan (32), and the like. The utilization control unit (33) in each utilization unit (30) according to the second embodiment, which is similar to that according to the first embodiment, controls the respective constituent elements of the utilization unit (30), based on detection signals from the various sensors of the utilization unit (30) and an external signal transmitted outside the utilization unit (30).

[Refrigerant Circuit]

The refrigerant circuit (11) according to the second embodiment, which is similar to that according to the first embodiment, is constituted of the heat source circuit (21) of the heat source unit (20) and the utilization circuit (31) of each utilization unit (30) that are connected to each other. The refrigerant circuit (11) according to the second embodiment includes a plurality of heat exchangers (12). In the second embodiment, the plurality of heat exchangers (12) include the heat source heat exchanger (50), the cooling heat exchanger (51), the intermediate cooler (52), and the utilization heat exchangers (70) of the utilization circuits (31) in the three utilization units (30). The refrigerant circuit (11) according to the second embodiment, which is similar to that according to the first embodiment, also includes, in addition to the plurality of heat exchangers (12), the constituent elements of the heat source circuit (21), such as the receiver (60), the degassing passage (61), the degassing valve (62), and the heat source expansion valve (65), and the constituent elements of each utilization circuit (31), such as the utilization expansion valve (75).

[Control Unit]

In the refrigeration system (10) according to the second embodiment, which is similar to that according to the first embodiment, the heat source control unit (23) and the plurality of utilization control units (33) constitute a control unit (15). As illustrated in FIG. 5, specifically, the heat source control unit (23) and the utilization control units (33) are connected to each other through communication lines. In addition, of the heat source control unit (23) and the plurality of utilization control units (33), the heat source control unit (23) mainly controls the respective constituent elements of the refrigeration system (10).

[Operations and Actions]

The refrigeration system (10) according to the second embodiment implements various operations such as a first heating and refrigeration-facility operating operation, a second heating and refrigeration-facility operating operation, and a cooling and refrigeration-facility operating operation.

[First Heating and Refrigeration-Facility Operating Operation]

Figure 6:
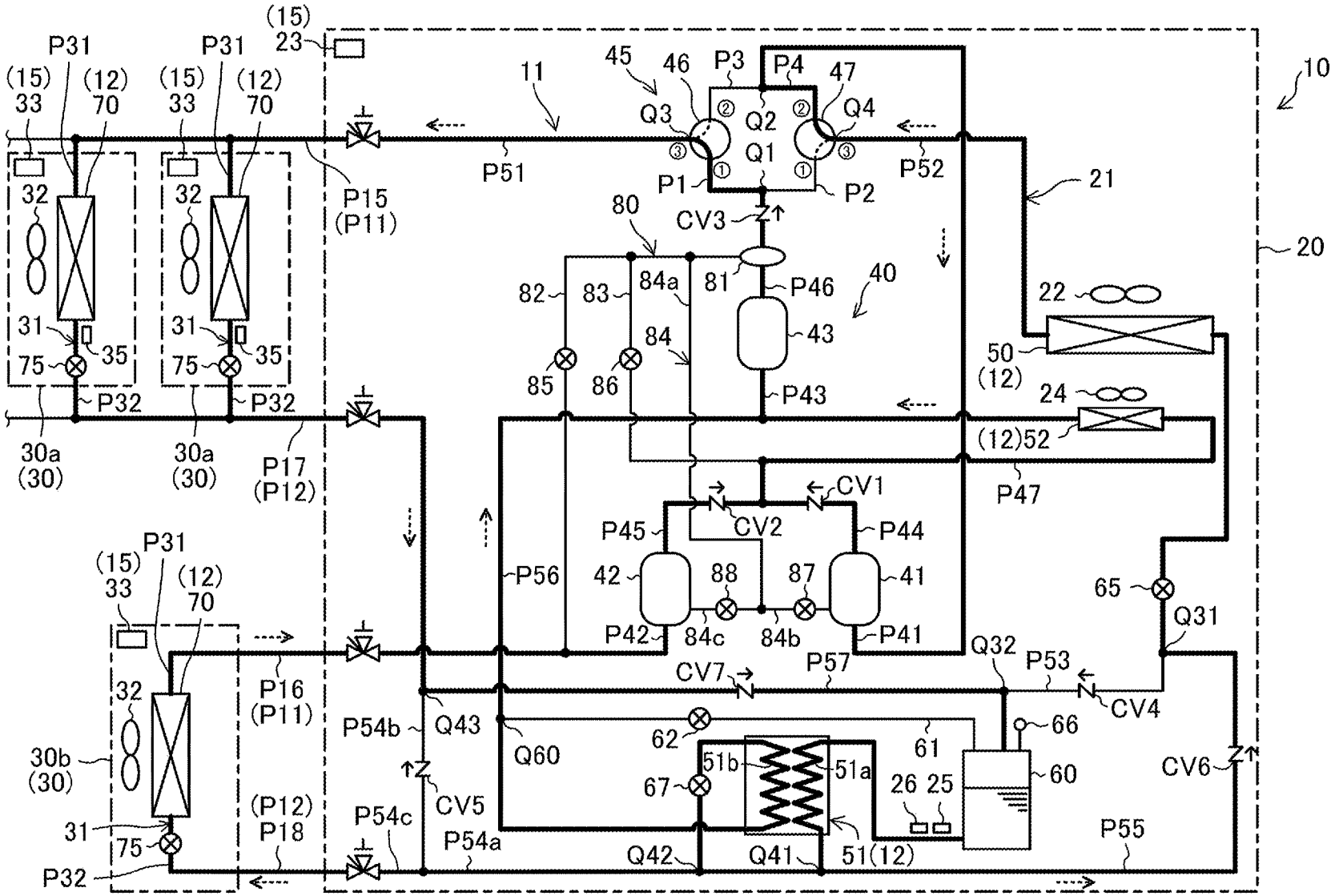
FIG. 6 is a diagram of an exemplary flow of a refrigerant during a first heating and refrigeration-facility operating operation.

With reference to FIG. 6, next, a description will be given of the first heating and refrigeration-facility operating operation. During the first heating and refrigeration-facility operating operation, the indoor units (30*a*) operate to heat the air in the room while the refrigeration facility unit (30*b*) operates to cool the air inside the refrigeration facility. The first heating and refrigeration-facility operating operation is carried out on a condition that a relatively large heating capacity is required for each of the indoor units (30*a*).

<States of Constituent Elements in Refrigeration System>

During the first heating and refrigeration-facility operating operation, in the heat source unit (20), the first three-way valve (46) is in a first state while the second three-way valve (47) is in a second state. In the flow path switching mechanism (45), the first port (Q1) and the third port (Q3) communicate with each other, and the second port (Q2) and the fourth port (Q4) communicate with each other. Each of the first to third compressors (41 to 43) is in a driven state, the heat source fan (22) is in a driven state, and the cooling fan (24) is in a stop state. The opening degree of the cooling expansion valve (67) is appropriately adjusted. The utilization fans (32) of the indoor units (30*a*) and refrigeration facility unit (30*b*) are driven.

<Action of Control Unit>

The control unit (15) maintains the opening degree of the heat source expansion valve (65) at a predetermined opening degree. The control unit (15) adjusts the opening degree of the utilization expansion valve (75) in the refrigeration facility unit (30*b*) such that the degree of superheating of the refrigerant flowing out of the utilization heat exchanger (70) becomes equal to a target degree of superheating.

The control unit (15) performs receiver pressure control. The receiver pressure control according to the second embodiment is similar to the receiver pressure control according to the first embodiment.

In addition, the control unit (15) performs utilization expansion valve control on each of the two indoor units (30*a*). The control unit (15) performs the utilization expansion valve control to adjust the opening degree of the utilization expansion valve (75) in each indoor unit (30*a*), in accordance with a pressure (RP) in the receiver (60). The utilization expansion valve control will be described in detail later.

<Details of Refrigeration Cycle>

During the first heating and refrigeration-facility operating operation, the utilization heat exchanger (70) of each indoor unit (30*a*) functions as a radiator, the heat source heat exchanger (50) of the heat source unit (20) functions as an evaporator, and the utilization heat exchanger (70) of the refrigeration facility unit (30*b*) functions as an evaporator. The refrigerant flows from the utilization heat exchanger (70) of each indoor unit (30*a*) into the receiver (60) via the utilization expansion valve (75) of the indoor unit (30*a*). The refrigerant then flows from the receiver (60) into the heat source heat exchanger (50) via the heat source expansion valve (65). The refrigerant also flows from the receiver (60) into the utilization heat exchanger (70) of the refrigeration facility unit (30*b*) via the utilization expansion valve (75) of the refrigeration facility unit (30*b*).

Specifically, the refrigerant is discharged from each of the first compressor (41) and the second compressor (42) of the heat source unit (20). The refrigerant then flows through the intermediate cooler (52). The refrigerant is then sucked into and compressed by the third compressor (43). The refrigerant is then discharged from the third compressor (43). The refrigerant then passes through the first three-way valve (46) and the first gas connection passage (P15). The refrigerant is then diverted toward the two indoor units (30*a*).

The refrigerant then flows into each indoor unit (30*a*) and dissipates heat in the utilization heat exchanger (70). The indoor air is thus heated. The refrigerant then flows out of the utilization heat exchanger (70) of each indoor unit (30*a*). The refrigerant is then decompressed by the utilization expansion valve (75). The refrigerant then passes through the first liquid connection passage (P17) and flows into the receiver (60) of the heat source unit (20).

The refrigerant then flows out of the receiver (60) of the heat source unit (20) through the liquid outlet of the receiver (60). The heat from the refrigerant is then absorbed by the refrigerant flowing through the second refrigerant passage (51*b*) of the cooling heat exchanger (51), on the first refrigerant passage (51*a*) of the cooling heat exchanger (51). After the refrigerant flows out of the first refrigerant passage (51*a*) of the cooling heat exchanger (51), a part of the refrigerant flows into the fifth passage (P55) and the remaining is diverted toward the sixth passage (P56) and the second liquid connection passage (P18).

The refrigerant, when flowing into the fifth passage (P55), is decompressed by the heat source expansion valve (65). The refrigerant then evaporates in the heat source heat exchanger (50). The refrigerant then flows out of the heat source heat exchanger (50). The refrigerant then passes through the second three-way valve (47) of the flow path switching mechanism (45). The refrigerant is then sucked into and compressed by the first compressor (41).

The refrigerant, when flowing into the sixth passage (P56), is decompressed by the cooling expansion valve (67). The refrigerant then flows through the second refrigerant passage (51*b*) of the cooling heat exchanger (51). The refrigerant is then sucked into and compressed by the third compressor (43).

The refrigerant, when flowing into the second liquid connection passage (P18), flows into the refrigeration facility unit (30*b*). The refrigerant is then decompressed by the utilization expansion valve (75). The refrigerant then evaporates in the utilization heat exchanger (70). The refrigerant then flows out of the utilization heat exchanger (70) of the refrigeration facility unit (30*b*). The refrigerant then passes through the second gas connection passage (P16). The refrigerant is then sucked into and compressed by the second compressor (42) of the heat source unit (20).

It should be noted that the first heating and refrigeration-facility operating operation is an example of a first heating operation. During the first heating operation, of the plurality of heat exchangers (12), the utilization heat exchanger (70) functions as a radiator, and the refrigerant flows from the utilization heat exchanger (70) into the receiver (60) via the utilization expansion valve (75). It should be noted that the first heating operation is an example of a first operation.

[Utilization Expansion Valve Control]

Figure 7:
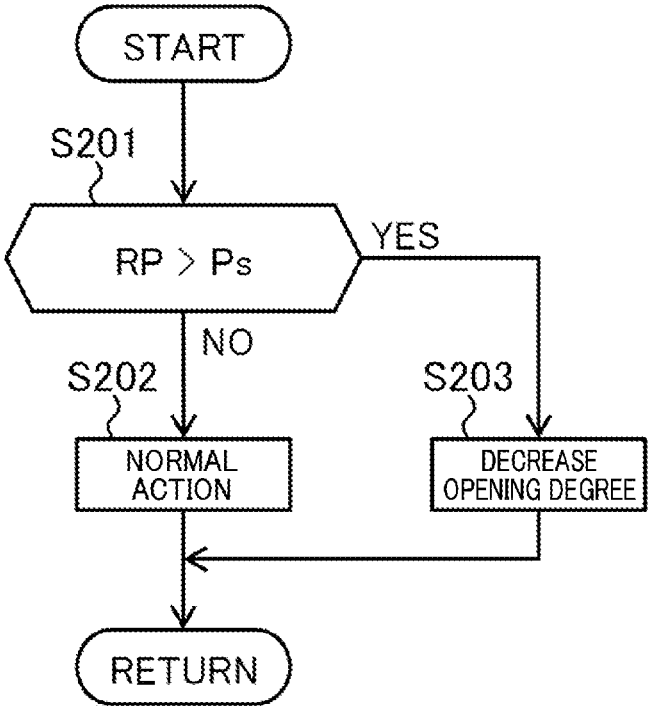
FIG. 7 is a flowchart of utilization expansion valve control.

With reference to FIG. 7, next, a description will be given of the utilization expansion valve control. During the first heating operation, the control unit (15) operates the utilization expansion valves (75) of the two indoor units (30*a*) to carry out the following steps.

<Step (S201)>

The control unit (15) determines whether the pressure (RP) in the receiver (60) exceeds a set pressure (Ps) set in advance. The set pressure (Ps) is higher than a first pressure (Pth1). The set pressure (Ps) may be higher than the critical pressure of the refrigerant. The set pressure (Ps) is preferably higher than a third pressure (Pth3). The set pressure (Ps) may be equal to or higher than a fourth pressure (Pth4). In this example, the set pressure (Ps) is lower than a working pressure at the pressure release valve (66). For example, when the fourth pressure (Pth4) is 8.3 MPa and the working pressure at the pressure release valve (66) is 8.4 MPa, the set pressure (Ps) is set at a pressure that is equal to or higher than 8.3 MPa and is less than 8.4 MPa.

When the pressure (RP) in the receiver (60) does not exceed the set pressure (Ps), the control unit (15) executes processing in step (S202). When the pressure (RP) in the receiver (60) exceeds the set pressure (Ps), the control unit (15) executes processing in step (S203).

<Step (S202)>

When the pressure (RP) in the receiver (60) does not exceed the set pressure (Ps), the control unit (15) adjusts the opening degree of the utilization expansion valve (75) in each indoor unit (30*a*) such that a temperature of the refrigerant flowing out of the utilization heat exchanger (70) in the indoor unit (30*a*) becomes equal to a target temperature set in advance. The target temperature is set at, for example, a temperature to be obtained by adding a predetermined value to a set temperature (a heating target temperature) that is set for the room where the indoor units (30*a*) are installed. In this example, the control unit (15) derives the temperature of the refrigerant flowing out of the utilization heat exchanger (70) in each indoor unit (30*a*), based on a detection signal from the refrigerant temperature sensor (35) in the indoor unit (30*a*). The control unit (15) then executes the processing in step (S201).

<Step (S203)>

When the pressure (RP) in the receiver (60) exceeds the set pressure (Ps), the control unit (15) decreases the opening degree of the utilization expansion valve (75) in each indoor unit (30*a*). For example, the control unit (15) decreases the opening degree of the utilization expansion valve (75) by lowering the target temperature set in advance, with respect to the temperature of the refrigerant flowing out of the utilization heat exchanger (70) in each indoor unit (30*a*). In this example, the control unit (15) decreases the opening degree of the utilization expansion valve (75) by an amount of change in opening degree set in advance. The control unit (15) then executes the processing in step (S201).

[Second Heating and Refrigeration-Facility Operating Operation]

Figure 8:
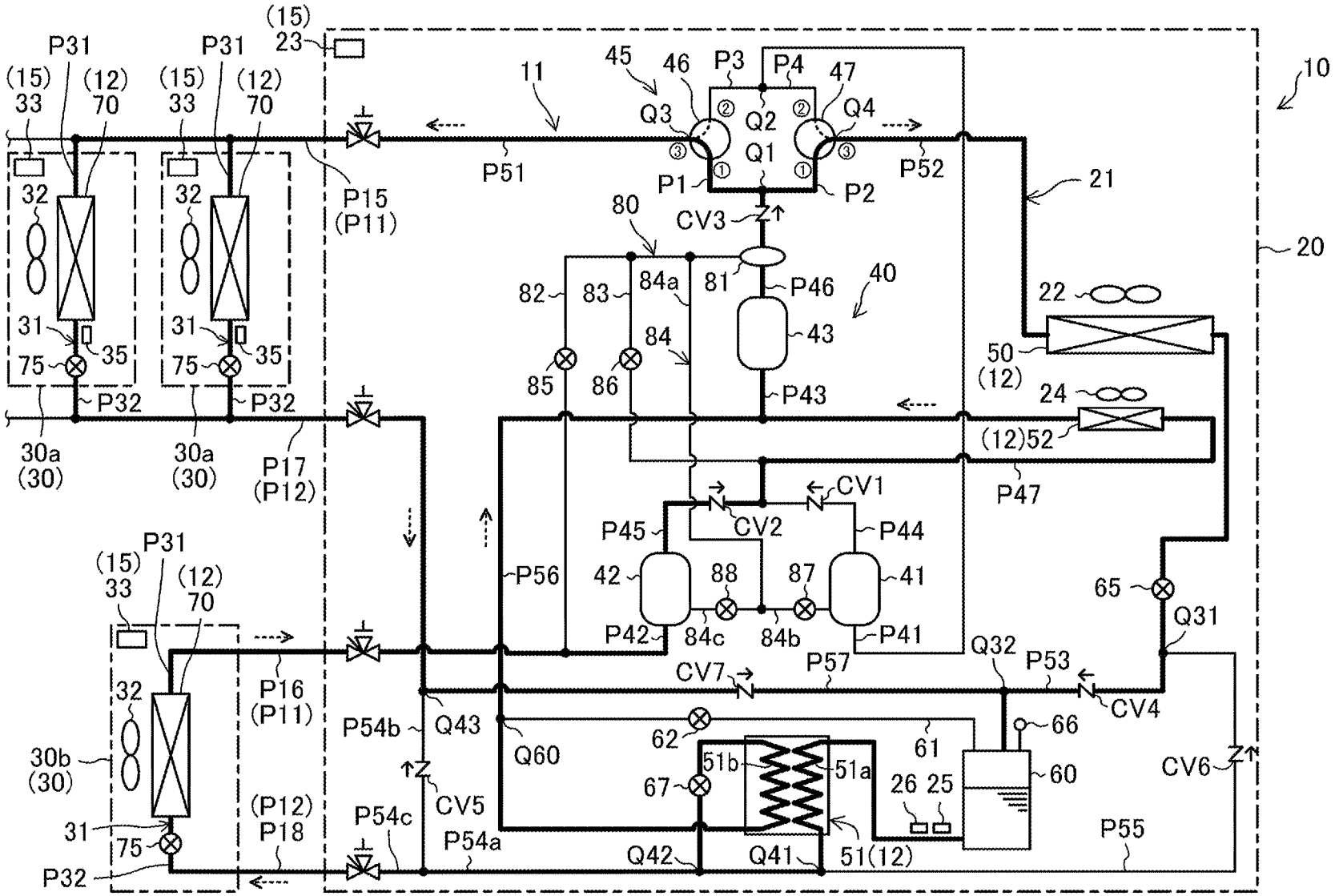
FIG. 8 is a diagram of an exemplary flow of the refrigerant during a second heating and refrigeration-facility operating operation.

With reference to FIG. 8, next, a description will be given of the second heating and refrigeration-facility operating operation. During the second heating and refrigeration-facility operating operation, the indoor units (30*a*) operate to heat the air in the room while the refrigeration facility unit (30*b*) operates to cool the air inside the refrigeration facility. The second heating and refrigeration-facility operating operation is carried out on a condition that a relatively small heating capacity is required for each of the indoor units (30*a*).

<States of Constituent Elements in Refrigeration System>

During the second heating and refrigeration-facility operating operation, in the heat source unit (20), the first three-way valve (46) is in the first state while the second three-way valve (47) is in the first state. In the flow path switching mechanism (45), the first port (Q1) communicates with the third port (Q3) and the fourth port (Q4). The first compressor (41) is in the stop state, each of the second compressor (42) and the third compressor (43) is in the driven state, the heat source fan (22) is in the driven state, and the cooling fan (24) is in the stop state. The opening degree of the cooling expansion valve (67) is appropriately adjusted. Each of the utilization fans (32) of the indoor units (30*a*) and refrigeration facility unit (30*b*) is in a driven state.

<Action of Control Unit>

The control unit (15) maintains the opening degree of the heat source expansion valve (65) at an opening degree set in advance. In addition, the control unit (15) controls a start or a stop of the heat source fan (22) in accordance with the pressure of the high-pressure refrigerant in the refrigerant circuit (11). Specifically, the control unit (15) stops the heat source fan (22) in the driven state when the pressure of the high-pressure refrigerant in the refrigerant circuit (11) takes a value larger than a first threshold value set in advance. The control unit (15) starts the heat source fan (22) in the stop state when the pressure of the high-pressure refrigerant in the refrigerant circuit (11) takes a value smaller than a second threshold value that is smaller than the first threshold value.

The control unit (15) adjusts the opening degrees of the utilization expansion valves (75) in the two indoor units (30*a*) such that the temperature of the refrigerant flowing out of each utilization heat exchanger (70) becomes equal to a target temperature set in advance.

The control unit (15) also adjusts the opening degree of the utilization expansion valve (75) in the refrigeration facility unit (30*b*) such that the degree of superheating of the refrigerant flowing out of the utilization heat exchanger (70) becomes equal to a target degree of superheating.

<Details of Refrigeration Cycle>

During the second heating and refrigeration-facility operating operation, the heat source heat exchanger (50) of the heat source unit (20) functions as a radiator, the utilization heat exchanger (70) of each indoor unit (30*a*) functions as a radiator, and the utilization heat exchanger (70) of the refrigeration facility unit (30*b*) functions as an evaporator. The refrigerant flows from the heat source heat exchanger (50) into the receiver (60) via the heat source expansion valve (65). The refrigerant also flows from the utilization heat exchanger (70) of each indoor unit (30*a*) into the receiver (60) via the utilization expansion valve (75) of the indoor unit (30*a*). The refrigerant also flows from the receiver (60) into the utilization heat exchanger (70) of the refrigeration facility unit (30*b*) via the utilization expansion valve (75) of the refrigeration facility unit (30*b*).

Specifically, the refrigerant is discharged from the second compressor (42) of the heat source unit (20). The refrigerant then flows through the intermediate cooler (52). The refrigerant is then sucked into and compressed by the third compressor (43). A part of the refrigerant discharged from the third compressor (43) flows into the heat source heat exchanger (50) via the second three-way valve (47) and dissipates heat in the heat source heat exchanger (50). The refrigerant then flows out of the heat source heat exchanger (50). The refrigerant is then decompressed by the heat source expansion valve (65). The refrigerant then flows into the receiver (60). The remaining of the refrigerant discharged from the third compressor (43) passes through the first three-way valve (46) and the first gas connection passage (P15). The refrigerant is then diverted toward the two indoor units (30*a*).

The refrigerant then flows into each indoor unit (30*a*) and dissipates heat in the utilization heat exchanger (70). The indoor air is thus heated. The refrigerant then flows out of the utilization heat exchanger (70) of each indoor unit (30*a*). The refrigerant is then decompressed by the utilization expansion valve (75). The refrigerant then passes through the first liquid connection passage (P17) and flows into the receiver (60) of the heat source unit (20).

The refrigerant then flows out of the receiver (60) of the heat source unit (20) through the liquid outlet of the receiver (60). The heat from the refrigerant is then absorbed by the refrigerant flowing through the second refrigerant passage (51*b*) of the cooling heat exchanger (51), on the first refrigerant passage (51*a*) of the cooling heat exchanger (51). The refrigerant then flows out of the first refrigerant passage (51*a*) of the cooling heat exchanger (51). The refrigerant is then diverted toward the sixth passage (P56) and the second liquid connection passage (P18).

The refrigerant, when flowing into the sixth passage (P56), is decompressed by the cooling expansion valve (67). The refrigerant then flows through the second refrigerant passage (51*b*) of the cooling heat exchanger (51). The refrigerant is then sucked into and compressed by the third compressor (43).

The refrigerant, when flowing into the second liquid connection passage (P18), flows into the refrigeration facility unit (30*b*). The refrigerant is then decompressed by the utilization expansion valve (75). The refrigerant then evaporates in the utilization heat exchanger (70). The refrigerant then flows out of the utilization heat exchanger (70) of the refrigeration facility unit (30*b*). The refrigerant then passes through the second gas connection passage (P16). The refrigerant is then sucked into and compressed by the second compressor (42) of the heat source unit (20).

It should be noted that the second heating and refrigeration-facility operating operation is an example of a second heating operation. During the second heating operation, the utilization heat exchangers (70) and the heat source heat exchanger (50) function as radiators. The refrigerant flows from each utilization heat exchanger (70) into the receiver (60) via the corresponding utilization expansion valve (75). The refrigerant also flows from the heat source heat exchanger (50) into the receiver (60) via the heat source expansion valve (65).

[Cooling and Refrigeration-Facility Operating Operation]

Figure 9:
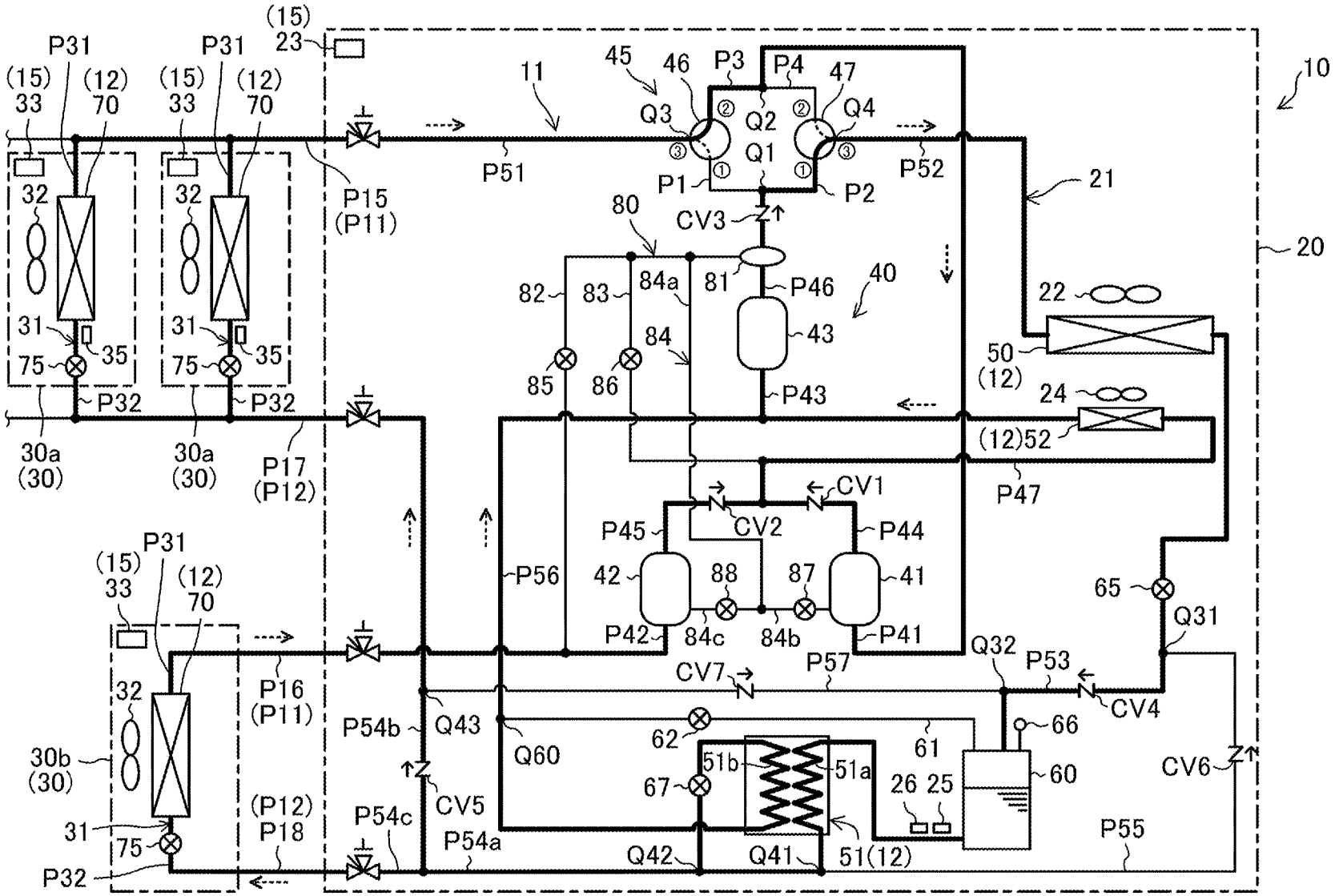
FIG. 9 is a diagram of an exemplary flow of the refrigerant during a cooling and refrigeration-facility operating operation.

With reference to FIG. 9, next, a description will be given of the cooling and refrigeration-facility operating operation. During the cooling and refrigeration-facility operating operation, the indoor units (30*a*) operate to cool the air in the room while the refrigeration facility unit (30*b*) operates to cool the air inside the refrigeration facility.

<States of Constituent Elements in Refrigeration System>

During the cooling and refrigeration-facility operating operation, in the heat source unit (20), the first three-way valve (46) is in the second state while the second three-way valve (47) is in the first state. In the flow path switching mechanism (45), the first port (Q1) and the fourth port (Q4) communicate with each other, and the second port (Q2) and the third port (Q3) communicate with each other. Each of the first to third compressors (41 to 43) is in the driven state, and each of the heat source fan (22) and the cooling fan (24) is in the driven state. The opening degree of the cooling expansion valve (67) is appropriately adjusted. Each of the utilization fans (32) of the indoor units (30*a*) and refrigeration facility unit (30*b*) is in the driven state.

<Action of Control Unit>

The control unit (15) adjusts the opening degree of the heat source expansion valve (65) in accordance with the pressure (RP) in the receiver (60). Specifically, the control unit (15) decreases the opening degree of the heat source expansion valve (65) as the pressure (RP) in the receiver (60) rises. The control unit (15) may fully open the heat source expansion valve (65) under normal circumstances and may decrease the opening degree of the heat source expansion valve (65) when the pressure (RP) in the receiver (60) rises. For example, the control unit (15) may maintain the heat source expansion valve (65) in the fully open state when the pressure (RP) in the receiver (60) does not take a value more than a threshold value set in advance and may decrease the opening degree of the heat source expansion valve (65) when the pressure (RP) in the receiver (60) takes a value more than the threshold value.

The control unit (15) adjusts the opening degrees of the utilization expansion valves (75) in the two indoor units (30*a*) and refrigeration facility unit (30*b*) such that the degree of superheating of the refrigerant flowing out of each utilization heat exchanger (70) becomes equal to the target degree of superheating.

<Details of Refrigeration Cycle>

During the cooling and refrigeration-facility operating operation, the heat source heat exchanger (50) of the heat source unit (20) functions as a radiator, the utilization heat exchanger (70) of each indoor unit (30*a*) functions as an evaporator, and the utilization heat exchanger (70) of the refrigeration facility unit (30*b*) functions as an evaporator. The refrigerant flows from the heat source heat exchanger (50) into the receiver (60) via the heat source expansion valve (65). The refrigerant also flows from the receiver (60) into the utilization heat exchanger (70) of each indoor unit (30*a*) via the utilization expansion valve (75) of the indoor unit (30*a*). The refrigerant also flows from the receiver (60) into the utilization heat exchanger (70) of the refrigeration facility unit (30*b*) via the utilization expansion valve (75) of the refrigeration facility unit (30*b*).

Specifically, the refrigerant is discharged from each of the first compressor (41) and the second compressor (42) of the heat source unit (20). The refrigerant then flows through the intermediate cooler (52). The refrigerant is then sucked into and compressed by the third compressor (43). The refrigerant is then discharged from the third compressor (43). The refrigerant then flows into the heat source heat exchanger (50) via the second three-way valve (47) and dissipates heat in the heat source heat exchanger (50). The refrigerant then flows out of the heat source heat exchanger (50). The refrigerant is then decompressed by the heat source expansion valve (65). The refrigerant then flows into the receiver (60).

The refrigerant then flows out of the receiver (60) through the liquid outlet of the receiver (60). The heat from the refrigerant is then absorbed by the refrigerant flowing through the second refrigerant passage (51*b*) of the cooling heat exchanger (51), on the first refrigerant passage (51*a*) of the cooling heat exchanger (51). After the refrigerant flows out of the first refrigerant passage (51*a*) of the cooling heat exchanger (51), a part of the refrigerant flows into the sixth passage (P56) and the remaining is diverted toward the first liquid connection passage (P17) and the second liquid connection passage (P18).

The refrigerant, when flowing into the sixth passage (P56), is decompressed by the cooling expansion valve (67). The refrigerant then flows through the second refrigerant passage (51*b*) of the cooling heat exchanger (51). The refrigerant is then sucked into and compressed by the third compressor (43).

The refrigerant, when flowing into the first liquid connection passage (P17), flows into each indoor unit (30*a*). The refrigerant is then decompressed by the utilization expansion valve (75). The refrigerant then evaporates in the utilization heat exchanger (70). The indoor air is thus cooled. The refrigerant then flows out of the utilization heat exchanger (70) of each indoor unit (30*a*). The refrigerant then passes through the first gas connection passage (P15) and the first three-way valve (46) of the heat source unit (20). The refrigerant is then sucked into and compressed by the first compressor (41).

The refrigerant, when flowing into the second liquid connection passage (P18), flows into the refrigeration facility unit (30*b*). The refrigerant is then decompressed by the utilization expansion valve (75). The refrigerant then evaporates in the utilization heat exchanger (70). The air inside the refrigeration facility is thus cooled. The refrigerant then flows out of the utilization heat exchanger (70) of the refrigeration facility unit (30*b*). The refrigerant then passes through the second gas connection passage (P16). The refrigerant is then sucked into and compressed by the second compressor (42) of the heat source unit (20).

It should be noted that the cooling and refrigeration-facility operating operation is an example of the cooling operation. During the cooling operation, the heat source heat exchanger (50) functions as a radiator while each utilization heat exchanger (70) functions as an evaporator. The refrigerant flows from the heat source heat exchanger (50) into the receiver (60) via the heat source expansion valve (65). The refrigerant then flows from the receiver (60) into each utilization heat exchanger (70).

Advantageous Effects of Second Embodiment

The refrigeration system (10) according to the second embodiment is capable of producing advantageous effects similar to the advantageous effects of the refrigeration system (10) according to the first embodiment. For example, the refrigeration system (10) according to the second embodiment implements the first operation (the first heating and refrigeration-facility operating operation) during which one of the plurality of heat exchangers (12) (i.e., the utilization heat exchanger (70) of each indoor unit (30*a*)) functions as a radiator while two of the plurality of heat exchangers (12) (i.e., the utilization heat exchanger (70) of the heat source heat exchanger (50) and the utilization heat exchanger (70) of the refrigeration facility unit (30*b*)) function as evaporators, and the refrigerant flows from the heat exchanger (12) functioning as a radiator into the receiver (60) and then flows from the receiver (60) into each of the two heat exchangers (12) functioning as evaporators. The control unit (15) changes the degassing valve (62) from the closed state to the open state when the pressure (RP) in the receiver (60) exceeds the first pressure (Pth1) in the first operation. As described above, when the degassing valve (62) is changed from the closed state to the open state, the pressure (RP) in the receiver (60) can be reduced in such a manner that the refrigerant in the gas state is discharged from the receiver (60) via the degassing passage (61). This configuration is therefore capable of inhibiting the drift of the refrigerant in each heat exchanger (12) functioning as an evaporator during the first operation.

The refrigeration system (10) according to the second embodiment also implements the first heating operation (the first heating and refrigeration-facility operating operation) which is an example of the first operation. During the first heating operation, each utilization heat exchanger (70) (i.e., the utilization heat exchanger (70) of each indoor unit (30*a*)) functions as a radiator, and the refrigerant flows from each utilization heat exchanger (70) into the receiver (60) via the corresponding utilization expansion valve (75) (i.e., the utilization expansion valve (75) of the indoor unit (30*a*)). The control unit (15) adjusts the opening degree of the utilization expansion valve (75) such that the temperature of the refrigerant flowing out of the utilization heat exchanger (70) becomes equal to the target temperature set in advance, in the first heating operation.

According to this configuration, air in the space where the utilization heat exchangers (70) (i.e., the utilization heat exchangers (70) of the indoor units (30*a*)) are placed can be heated by the first heating operation.

Also in the refrigeration system (10) according to the second embodiment, in the first heating operation (the first heating and refrigeration-facility operating operation), when the pressure (RP) in the receiver (60) exceeds the set pressure (Ps), the control unit (15) decreases the opening degree of the utilization expansion valve (75) (i.e., the utilization expansion valve (75) of each indoor unit (30*a*)).

According to this configuration, the pressure (RP) in the receiver (60) can be reduced by decreasing the opening degree of the utilization expansion valve (75) (i.e., the utilization expansion valve (75) of each indoor unit (30*a*)).

The refrigeration system (10) according to the second embodiment implements the second heating operation (the second heating and refrigeration-facility operating operation) during which the utilization heat exchangers (70) (i.e., the utilization heat exchangers (70) of the indoor units (30*a*)) and the heat source heat exchanger (50) function as radiators, the refrigerant flows from each utilization heat exchanger (70) into the receiver (60) via the corresponding utilization expansion valve (75) (i.e., the utilization expansion valve (75) of each indoor unit (30*a*)), and the refrigerant flows from the heat source heat exchanger (50) into the receiver (60) via the heat source expansion valve (65).

According to this configuration, air in the space where the utilization heat exchangers (70) are placed can be heated by the second heating operation.

Also in the refrigeration system (10) according to the second embodiment, the control unit (15) adjusts the opening degree of each utilization expansion valve (75) (i.e., the utilization expansion valve (75) of each indoor unit (30*a*)) such that the temperature of the refrigerant flowing out of the corresponding utilization heat exchanger (70) (i.e., the utilization heat exchanger (70) of each indoor unit (30*a*)) becomes equal to the target temperature, and maintains the opening degree of the heat source expansion valve (65) at the opening degree set in advance, in the second heating operation (the second heating and refrigeration-facility operating operation).

According to this configuration, the opening degree of the heat source expansion valve (65) can be maintained at the opening degree set in advance, in the second heating operation (the second heating and refrigeration-facility operating operation). This configuration is capable facilitating control of the heat source expansion valve (65) as compared with, for example, a case where the opening degree of the heat source expansion valve (65) is adjusted such that the temperature of the refrigerant flowing out of the heat source heat exchanger (50) becomes equal to the target temperature set in advance.

The refrigeration system (10) according to the second embodiment also implements the cooling operation (the cooling and refrigeration-facility operating operation) during which the heat source heat exchanger (50) functions as a radiator while the utilization heat exchangers (70) (i.e., the utilization heat exchangers (70) of the indoor units (30*a*)) function as evaporators, and the refrigerant flows from the heat source heat exchanger (50) into the receiver (60) via the heat source expansion valve (65) and then flows from the receiver (60) into each utilization heat exchanger (70). The control unit (15) adjusts the opening degree of the heat source expansion valve (65) in accordance with the pressure (RP) in the receiver (60) in the cooling operation.

According to this configuration, air in the space where the utilization heat exchangers (70) (i.e., the utilization heat exchangers (70) of the indoor units (30*a*)) are placed can be cooled by the cooling operation. In addition, the pressure (RP) in the receiver (60) can be adjusted by the heat source expansion valve (65) in the cooling operation.

Modifications of Second Embodiment

The refrigeration system (10) according to the second embodiment may include three or more indoor units (30*a*). The refrigeration system (10) according to the second embodiment may include two or more refrigeration facility units (30*b*). The heat source unit (20) according to the second embodiment may include two or more heat source heat exchangers (50). For example, during the first heating and refrigeration-facility operating operation which is an example of the first operation, the utilization heat exchangers (70) of the three or more indoor units (30*a*) may function as radiators, the utilization heat exchangers (70) of the two or more heat source heat exchangers (50) may function as evaporators, and the utilization heat exchangers (70) of the two or more refrigeration facility units (30*b*) may function as evaporators.

The control unit (15) according to the second embodiment may be configured to perform the receiver pressure control in the cooling and refrigeration-facility operating operation.

The refrigeration system (10) according to the second embodiment may implement a simple cooling operation during which the indoor units (30*a*) operate while the refrigeration facility unit (30*b*) stops. During the simple cooling operation, the heat source heat exchanger (50) of the heat source unit (20) functions as a radiator while the utilization heat exchangers (70) of the utilization units (30*a*) function as evaporators. The control unit (15) may be configured to perform the receiver pressure control in the simple cooling operation. The simple cooling operation is an example of the first operation and is also an example of the cooling operation.

In the case where the refrigeration system (10) according to the second embodiment includes two or more refrigeration facility units (30*b*), the refrigeration system (10) may implement a refrigeration-facility operating operation during which the refrigeration facility units (30*b*) operate while the indoor units (30*a*) stop. During the refrigeration-facility operating operation, the heat source heat exchanger (50) of the heat source unit (20) functions as a radiator while the utilization heat exchangers (70) of the refrigeration facility units (30*b*) function as evaporators. The control unit (15) may be configured to perform the receiver pressure control in the refrigeration-facility operating operation. The refrigeration-facility operating operation is an example of the first operation and is also an example of the cooling operation.

Other Embodiments

The number of heat exchangers (12) functioning as radiators during the first operation is not limited to one. The number of heat exchangers (12) functioning as evaporators during the first operation is not limited to two. During the first operation, of the plurality of heat exchangers (12) in the refrigerant circuit (11), at least one heat exchanger (12) functions as a radiator while two or more heat exchangers (12) function as evaporators.

A heat exchanger (12) functioning as a radiator during the first heating operation is not limited to a utilization heat exchanger (70). For example, during the first heating operation, of the plurality of heat exchangers (12) in the refrigerant circuit (11), a heat exchanger (12) different from the utilization heat exchanger (70) may function as a radiator, in addition to the utilization heat exchanger (70). During the first heating operation, of the plurality of heat exchangers (12) in the refrigerant circuit (11), at least one utilization heat exchanger (70) functions as a radiator.

Heat exchangers (12) functioning as radiators during the second heating operation are not limited to a utilization heat exchanger (70) and a heat source heat exchanger (50). For example, during the second heating operation, of the plurality of heat exchangers (12) in the refrigerant circuit (11), a heat exchanger (12) different from the utilization heat exchanger (70) and the heat source heat exchanger (50) may function as a radiator, in addition to the utilization heat exchanger (70) and the heat source heat exchanger (50). During the second heating operation, of the plurality of heat exchangers (12) in the refrigerant circuit (11), at least one utilization heat exchanger (70) and at least one heat source heat exchanger (50) function as radiators.

A heat exchanger (12) functioning as a radiator during the cooling operation is not limited to one heat source heat exchanger (50). A heat exchanger (12) functioning as an evaporator during the cooling operation is not limited to one utilization heat exchanger (70). During the cooling operation, of the plurality of heat exchangers (12) in the refrigerant circuit (11), at least one heat source heat exchanger (50) functions as a radiator while at least one utilization heat exchanger (70) functions as an evaporator.

The foregoing ordinal numbers such as "first", "second", and "third" are merely used for distinguishing the elements designated with the ordinal numbers, and are not intended to limit the number and order of the elements.

While the embodiments and modifications have been described herein above, it is to be appreciated that various changes in form and detail may be made without departing from the spirit and scope presently or hereafter claimed. In addition, the foregoing embodiments and modifications may be appropriately combined or substituted as long as the combination or substitution does not impair the functions of the present disclosure.

INDUSTRIAL APPLICABILITY

As described above, the present disclosure is useful for a refrigeration system.

REFERENCE SIGNS LIST

10: refrigeration system
11: refrigerant circuit
12: heat exchanger
15: control unit
20: heat source unit
21: heat source circuit
22: heat source fan
23: heat source control unit
30: utilization unit
31: utilization circuit
32: utilization fan
33: utilization control unit
40: compression element
50: heat source heat exchanger
60: receiver
61: degassing passage
62: degassing valve
65: heat source expansion valve
66: pressure release valve
70: utilization heat exchanger
75: utilization expansion valve

The invention claimed is:

1. A refrigeration system comprising:

a refrigerant circuit in which carbon dioxide circulates as a refrigerant; and a control unit, wherein the refrigerant circuit includes:

a plurality of heat exchangers;

a receiver;

a degassing passage through which the refrigerant in a gas state is discharged from the receiver; and a degassing valve disposed on the degassing passage, the refrigeration system implements a first operation during which one of the plurality of heat exchangers functions as a radiator while two of the plurality of heat exchangers function as evaporators, and the refrigerant flows from the heat exchanger functioning as the radiator into the receiver and then flows from the receiver into each of the two heat exchangers functioning as evaporators, and the control unit changes the degassing valve from a closed state to an open state on a condition that a pressure in the receiver exceeds a first pressure set in advance, in the first operation.

2. The refrigeration system according to claim 1, wherein the first pressure is equal to or lower than a critical pressure of the refrigerant.

3. The refrigeration system according to claim 1, wherein the plurality of heat exchangers include a utilization heat exchanger, the refrigerant circuit includes a utilization expansion valve, the first operation is a first heating operation during which the utilization heat exchanger functions as a radiator and the refrigerant flows from the utilization heat exchanger into the receiver via the utilization expansion valve, and the control unit adjusts an opening degree of the utilization expansion valve such that a temperature of the refrigerant flowing out of the utilization heat exchanger becomes equal to a target temperature set in advance, in the first heating operation.

4. The refrigeration system according to claim 3, wherein in the first heating operation, on a condition that the pressure in the receiver exceeds a set pressure higher than the first pressure, the control unit decreases the opening degree of the utilization expansion valve.

5. The refrigeration system according to claim 3, wherein the plurality of heat exchangers include a heat source heat exchanger, the refrigerant circuit includes a heat source expansion valve, and the refrigeration system implements a second heating operation during which the utilization heat exchanger and the heat source heat exchanger function as radiators, the refrigerant flows from the utilization heat exchanger into the receiver via the utilization expansion valve, and the refrigerant flows from the heat source heat exchanger into the receiver via the heat source expansion valve.

6. The refrigeration system according to claim 5, wherein in the second heating operation, the control unit adjusts the opening degree of the utilization expansion valve such that the temperature of the refrigerant flowing out of the utilization heat exchanger becomes equal to the target temperature set in advance, and maintains an opening degree of the heat source expansion valve at an opening degree set in advance.

7. The refrigeration system according to claim 5, wherein the refrigeration system implements a cooling operation during which the heat source heat exchanger functions as a radiator while the utilization heat exchanger functions as an evaporator, and the refrigerant flows from the heat source heat exchanger into the receiver via the heat source expansion valve and then flows from the receiver into the utilization heat exchanger, and the control unit adjusts an opening degree of the heat source expansion valve in accordance with the pressure in the receiver, in the cooling operation.

8. The refrigeration system according to claim 1, wherein in the first operation, on a condition that the pressure in the receiver falls within a first range from a second pressure lower than the first pressure to a third pressure higher than the first pressure, the control unit adjusts an opening degree of the degassing valve such that the pressure in the receiver becomes equal to a target pressure that is set in advance within the first range and is equal to or lower than a critical pressure of the refrigerant.

9. The refrigeration system according to claim 8, wherein the plurality of heat exchangers include a utilization heat exchanger, the refrigerant circuit includes a utilization expansion valve, the first operation is a first heating operation during which the utilization heat exchanger functions as a radiator and the refrigerant flows from the utilization heat exchanger into the receiver via the utilization expansion valve, and the control unit adjusts an opening degree of the utilization expansion valve such that a temperature of the refrigerant flowing out of the utilization heat exchanger becomes equal to a target temperature set in advance, in the first heating operation.

10. The refrigeration system according to claim 8, wherein in the first operation, on a condition that the pressure in the receiver is lower than the second pressure, the control unit decreases the opening degree of the degassing valve as the pressure in the receiver reduces.

11. The refrigeration system according to claim 10, wherein the plurality of heat exchangers include a utilization heat exchanger, the refrigerant circuit includes a utilization expansion valve, the first operation is a first heating operation during which the utilization heat exchanger functions as a radiator and the refrigerant flows from the utilization heat exchanger into the receiver via the utilization expansion valve, and the control unit adjusts an opening degree of the utilization expansion valve such that a temperature of the refrigerant flowing out of the utilization heat exchanger becomes equal to a target temperature set in advance, in the first heating operation.

12. The refrigeration system according to claim 8, wherein in the first operation, on a condition that the pressure in the receiver reaches a second range from the third pressure to a fourth pressure higher than the third pressure, the control unit increases the opening degree of the degassing valve as the pressure in the receiver rises.

13. The refrigeration system according to claim 12, wherein in the first operation, on condition a condition that the pressure in the receiver is lower than the second pressure, the control unit decreases the opening degree of the degassing valve as the pressure in the receive reduces.

14. The refrigeration system according to claim 12, wherein the plurality of heat exchangers include a utilization heat exchanger, the refrigerant circuit includes a utilization expansion valve, the first operation is a first heating operation during which the utilization heat exchanger functions as a radiator and the refrigerant flows from the utilization heat exchanger into the receiver via the utilization expansion valve, and the control unit adjusts an opening degree of the utilization expansion valve such that a temperature of the refrigerant flowing out of the utilization heat exchanger becomes equal to a target temperature set in advance, in the first heating operation.

15. The refrigeration system according to claim 12, wherein in the first operation, on a condition that the pressure in the receiver is higher than the fourth pressure, the control unit maintains the opening degree of the degassing valve at a maximum opening degree set in advance.

16. The refrigeration system according to claim 15, wherein in the first operation, on a condition that the pressure in the receiver is lower than the second pressure, the control unit decreases the opening degree of the degassing valve as the pressure in the receiver reduces.

17. The refrigeration system according to claim 15, wherein the plurality of heat exchangers include a utilization heat exchanger, the refrigerant circuit includes a utilization expansion valve, the first operation is a first heating operation during which the utilization heat exchanger functions as a radiator and the refrigerant flows from the utilization heat exchanger into the receiver via the utilization expansion valve, and the control unit adjusts an opening degree of the utilization expansion valve such that a temperature of the refrigerant flowing out of the utilization heat exchanger becomes equal to a target temperature set in advance, in the first heating operation.

18. A heat source unit constituting, together with a plurality of utilization units each including a utilization circuit, a refrigeration system including a refrigerant circuit in which carbon dioxide circulates as a refrigerant, the refrigerant circuit including a plurality of heat exchangers, a receiver, a degassing passage through which the refrigerant in a gas state is discharged from the receiver, and a degassing valve disposed on the degassing passage, the refrigeration system implementing a first operation during which one of the plurality of heat exchangers functions as a radiator while two of the plurality of heat exchangers function as evaporators, and the refrigerant flows from the heat exchanger functioning as a radiator into the receiver and then flows from the receiver into each of the two heat exchangers functioning as evaporators, the heat source unit comprising:

a heat source circuit connected to the utilization circuits of the utilization units to constitute the refrigerant circuit; and a heat source control unit configured to change the degassing valve from a closed state to an open state on a condition that a pressure in the receiver exceeds a first pressure set in advance, in the first operation.

* * * * *